US005966556A

United States Patent [19]

Nakagawa et al.

[11] Patent Number: 5,966,556

[45] Date of Patent: Oct. 12, 1999

[54] METHOD OF DUPLEX COPYING DOCUMENTS

[75] Inventors: Yuji Nakagawa, Soraku-gun; Yuji Okamoto, Nara, both of Japan

[73] Assignee: Sharp Kabushiki Kaisha, Osaka, Japan

[21] Appl. No.: 09/085,012

[22] Filed: May 28, 1998

[30] Foreign Application Priority Data

May 28, 1997 [JP] Japan ..... 9-138054

[51] Int. Cl.[6] ..... G03G 15/00

[52] U.S. Cl. ..... 399/18; 271/3.03; 271/3.04; 399/364; 399/374; 399/402

[58] Field of Search ..... 399/16, 17, 18, 399/363, 364, 373, 374, 401, 402; 271/3.03, 3.04, 3.17, 65, 186, 301

[56] References Cited

U.S. PATENT DOCUMENTS

| | | | |
|---|---|---|---|
| 4,639,126 | 1/1987 | Bushaw et al. | 399/364 |
| 4,674,866 | 6/1987 | Tanaka | 399/374 |
| 5,034,771 | 7/1991 | Makita | 399/21 |
| 5,216,473 | 6/1993 | Maeyama | 399/364 |
| 5,826,154 | 10/1998 | Yamashita et al. | 399/364 |

FOREIGN PATENT DOCUMENTS 2-176766A 7/1990 Japan .

*Primary Examiner*—William Royer
*Assistant Examiner*—William A. Noë

[57] ABSTRACT

A method is provided for copying in which a duplex copy can be smoothly made. In making N sets of double-sided copies of M one-sided documents, a method of copying includes a first document circulating step of copying images of even ordinal numbered documents on unused sheets and then stores these sheets into an intermediate tray. The second document circulating step of copying images of odd ordinal numbered documents on rear faces of one-side copied sheets forming double-sided copied sheets which are discharged. A cycle detecting solenoid for separating each circulation of the one-sided documents is provided and breakdown judging step of judging by a controlling device that a cycle detection sensor is out of order in the case where the cycle detecting solenoid is operated and a polarity of the cycle detection sensor is not changed.

4 Claims, 19 Drawing Sheets

DOCUMENT SIX SHEETS

| | | | | | | |
|---|---|---|---|---|---|---|
| 1st CIRCULATION | ⑥ | 5 | ④ | 3 | ② | 1 |
| 2nd CIRCULATION | 6 | △5 | 4 | △3 | 2 | △1 |
| $n^{th}$ CIRCULATION | ⑥ | 5 | ④ | 3 | ② | 1 |
| $(n+1)^{th}$ CIRCULATION | 6 | △5 | 4 | △3 | 2 | △1 |

○ : CONVEY DOCUMENT FROM SHEET FEEDER TO INTERMEDIATE TRAY

△ : DISCHARGE DOCUMENT FROM INTERMEDIATE TRAY

_ : CONVEY DOCUMENT WITHOUT IMAGE TRANSFER

FIG. 31

DOCUMENT TWO SHEETS

| | | | |
|---|---|---|---|
| 1st CIRCULATION | ① | ② | * |
| 2nd CIRCULATION | ① | ② | |
| 3rd CIRCULATION | △3 | △4 | * |
| 4th CIRCULATION | △3 | △4 | |

○ : CONVEY DOCUMENT FROM SHEET FEEDER TO INTERMEDIATE TRAY

△ : DISCHARGE DOCUMENT FROM INTERMEDIATE TRAY

* : CYCLE DETECTION LEVER IS OPERATED

FIG. 32

DOCUMENT TWO SHEETS

| | | |
|---|---|---|
| 1st CIRCULATION | ① | ② |
| 2nd CIRCULATION | △3 | △4 |
| 3rd CIRCULATION | ① | ② |
| 4th CIRCULATION | △3 | △4 |

○ : CONVEY DOCUMENT FROM SHEET FEEDER TO INTERMEDIATE TRAY

△ : DISCHARGE DOCUMENT FROM INTERMEDIATE TRAY

METHOD OF DUPLEX COPYING DOCUMENTS

BACKGROUND OF THE INVENTION

1. Field of the Invention

The present invention relates to a method for copying by an image forming apparatus such as a copying machine capable of making a duplex copy in a manner that in a first circulation of documents fed from document feeding means, sheets onto whose one side an image of one of even or odd ordinal numbered documents is transferred (referred to one-side-transferred sheets hereinafter) are stored in an intermediate tray, and in a second circulation of the documents, the one-side-transferred sheets stored in the intermediate tray are fed to image transferring means to transfer an image of the other pages of the documents onto the other side of the one-side-transferred sheets.

2. Description of the Related Art

With reference to a method for copying by a conventional copying machine, it is known that an intermediate tray of the copying machine comprises a cycle detecting sensor and a cycle detecting lever, wherein the lever is provided with the sensor and, in a mode that two sets of copy of the documents are temporarily stocked in the intermediate tray, for example, in S→D mode (one-sided documents to double-sided copy), used for separating each set.

In the prior art, when it is judged that the cycle detecting sensor is out of order, an operation of copying in S→D mode is disabled and a double-sided copy cannot be obtained.

Even when the cycle detecting sensor is out of order, a duplex copy can be made, with the result that the user does not notice that a breakdown has occurred and hence the breakdown remains without being fixed. In the case where an operation of copying in S→D mode is continued without the breakdown being fixed, a drum is caused to rotate in skip mode about two times as many as the case of non-skip mode, so that a problem will arise such that the drum cannot last for the specified life time.

In a state that a sensor for detecting the presence or absence of sheets in the intermediate tray does not detect the presence of sheets and the cycle detecting sensor of the intermediate tray is off, when a copying operation is started, the copying machine stops operating due to a misdetection of the sensor.

In the prior art, when it is judged that the cycle detecting sensor is out of order, an operation of copying in D→D mode (double-sided documents to double-sided copy) is disabled and a double-sided copy cannot be obtained.

SUMMARY OF THE INVENTION

An object of the invention is to provide a method for copying in which a duplex copy can be smoothly made.

In a first aspect of the invention, a method of copying for forming N sets of double-sided copies by circulating one-sided documents, comprises:

a first document circulating step of copying images of even ordinal numbered ones of the one-sided documents on unused sheets and then storing the one-side copied sheets into an intermediate tray;

a second document circulating step of copying images of odd ordinal numbered ones of the one-sided documents on rear faces of the one-side copied sheets sent from the intermediate tray, discharging the double-side copied sheets, copying the images of the even ordinal numbered ones of the one-sided documents on unused sheets and then storing the one-side copied sheets into the intermediate tray;

a third document circulating step of copying images of odd ordinal numbered ones of the one-sided documents on rear faces of the one-side copied sheets sent from the intermediate tray and then discharging the double-side copied sheets;

a cycle judging step of judging by a cycle detecting sensor that in each step, every time M/2 sheets for M one-sided documents are stored into the intermediate tray, a cycle detecting solenoid for separating each circulation of the one-sided documents is operated; and breakdown judging step of judging by controlling means that the cycle detection sensor is out of order in the case where the cycle detecting solenoid is operated and a polarity of the cycle detection sensor is not changed, the method of copying in which N sets of double-sided copies are formed by sequentially executing the first document circulating step once, the second document circulating step (N−1) times, and the third document circulating step once, wherein when it is judged in the breakdown judging step that the cycle detecting sensor is out of order, an operation of executing once the first document circulating step and once the third document circulating step in turn is repeated to form N sets of double-sided copy.

In a second aspect of the invention, the method of copying further comprises a displaying step of displaying on a display unit that copying is performed in skip mode in the case where in the breakdown judging step it is determined that the cycle detecting sensor is out of order.

In a third aspect of the invention, a method of copying for forming N sets of double-sided copies by circulating double-sided documents, comprises:

a fourth document circulating step of copying images of rear faces of the double-sided documents on unused sheets and then storing the one-side copied sheets into an intermediate tray;

a fifth document circulating step of copying images of front faces of the double-sided documents on rear faces of the one-side copied sheets sent from the intermediate tray and then discharging the double-side copied sheets;

cycle judging step of judging by a cycle detecting sensor that every time M sheets for M documents are stored into the intermediate tray in the fourth document circulating step, a cycle detecting solenoid for separating each circulation of the double-sided documents is operated; and breakdown judging step of judging by controlling means that the cycle detection sensor is out of order in the case where the cycle detecting solenoid is operated and a polarity of the cycle detection sensor is not changed, the method of copying in which N sets of double-sided copies are formed by repeating an operation of executing the fourth document circulating step two times and the fifth document circulating step two times in turn is repeated until the fourth document circulating step is executed N times and the fifth document circulating step is executed N times, wherein when it is judged in the breakdown judging step that the cycle detecting sensor is out of order, an operation of executing once the fourth document circulating step and once the fifth document circulating step in turn is repeated N times to form N sets of double-sided copy, In a fourth aspect of the invention, the method of copying is characterized in that a sensor capable of detecting the presence or absence of sheet is provided in the intermediate tray, and characterized by another breakdown judging step of determining that the cycle detecting sensor of the intermediate tray is out of order, when the sensor does not detect the presence of sheet and the cycle detecting sensor of the intermediate tray is off.

According to the first aspect of the invention, even when it is determined that the cycle detecting sensor is out of order, the operation of executing the first document circulating step N times and the third document circulating step N times in turn is repeated to make N sets of double-sided copies. Moreover, downtime with respect to S→D mode can be eliminated.

According to the second aspect of the invention, when it is judged that the cycle detecting sensor of the intermediate tray is out of order, it is indicated on the display unit that the cycle detecting sensor is out of order and hence copying is performed in skip mode. In this configuration, the user can easily notice an occurrence of a breakdown to be resolved.

According to the third aspect of the invention, when it is judged that the cycle detecting sensor is out of order, N times of the fourth document circulating step and N times of the fifth document circulating step are executed in turn for one time each to form N sets of double-sided copy. Moreover, downtime with respect to D→D mode can be eliminated.

According to the fourth aspect of the invention, a sensor capable of detecting the presence or absence of sheets is disposed to the intermediate tray, and when the sensor does not detect the presence of sheets and the cycle detecting sensor disposed to the intermediate tray is off, it is judged that the cycle detecting sensor of the intermediate tray is out of order. In this configuration, it is possible to prevent the copying machine from stopping its operation due to a misdetection of the sensor.

BRIEF DESCRIPTION OF THE DRAWINGS

Other and further objects, features, and advantages of the invention will be more explicit from the following detailed description taken with reference to the drawings wherein:

FIG. 31 is a view showing a first operation state of the copying machine of the present invention in D→D mode; and FIG. 32 is a view showing a second operation state of the copying machine of the present invention in D→D mode.

DETAILED DESCRIPTION OF THE PREFERRED EMBODIMENTS

Figure 1:
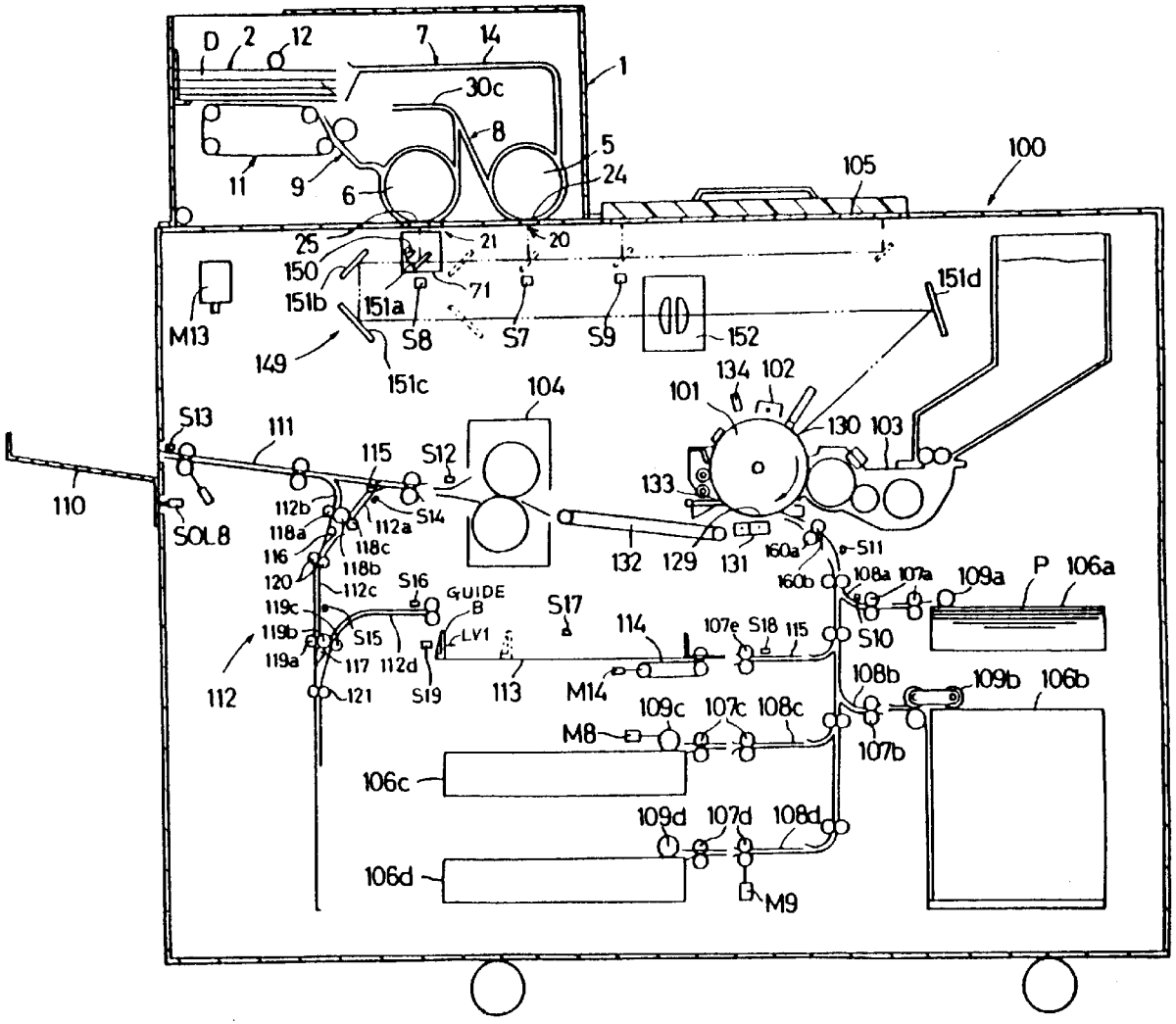
FIG. 1 is a section view of a copying machine in which a circulative document feeder of the invention is mounted.

Now referring to the drawings, preferred embodiments of the invention are described below.

FIG. 1 is a schematic sectional view showing the basic configuration of a transfer-type electrostatic copying machine equipped with a recirculating document handler 1 which is so called RDH (Recirculating Document Handler) or the like. In the center inside a body 100 of the copying machine, a right-circular cylindrical photoconductor 101 is disposed so as to be rotatable at a constant speed. On the outer periphery of the photoconductor 101, are provided sections for various copying processes as well as a corona discharger 102 for the use of charging, a developing unit 103, and the like. A fixing unit 104 is disposed on the left side of the photoconductor 101 as viewed in the figure.

The recirculating document handler 1 is provided on the top surface of the body 100 of the copying machine. A first reading position 20 and a second reading position 21 located vertically below a first support cylinder 5 and a second support cylinder 6, respectively, are provided in parallel and generally on substantially the same plane on the top surface of the body 100. Also on the top surface of the body 100 of the copying machine, a third reading position 105 corresponding to a bound book or the like is provided, constituting exposure means 149 that is capable of a two-system reading exposure.

Figure 2:
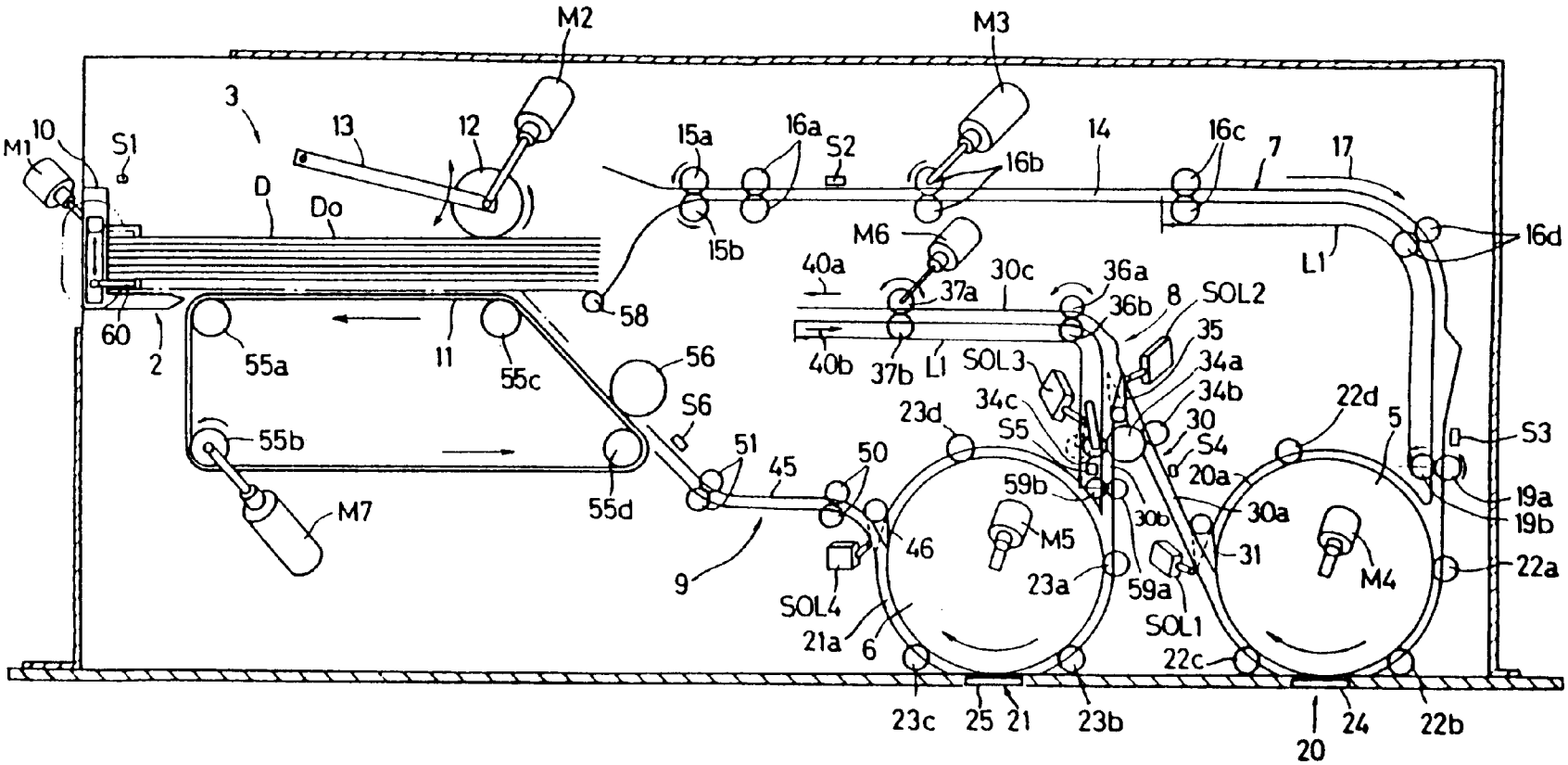
FIG. 2 is a section view of the circulative document feeder of FIG. 1.

FIG. 2 is a schematic sectional view of the recirculating document handler 1. The recirculating document handler 1 comprises: a document storage 2 which is storage means for storing documents; sheet feed means 3 for feeding the documents one by one from the document storage 2; the right-circular cylindrical first support cylinder 5 which conveys a document along the outer peripheral surface so as to cause its one-side surface to confront the first reading position 20; the right-circular cylindrical second support cylinder 6 which causes the other-side surface of the conveyed document to confront the second reading position 21; document feed means 7 for conveying a document from the document storage 2 to the first support cylinder 5; document reversal means 8 which is intervened between the first support cylinder 5 and the second support cylinder 6 and which reverses the document under conveyance so that, as one surface of the document confronts the first reading position 20, the other surface thereof will confront the second reading position 21; and document storage means 9 for returning the document from the second support cylinder 6 to the document storage 2.

The document storage 2 accepts a plurality of documents D put in order of their attached page numbers, in the state that one-end portion (left-side end portion in FIG. 1) of the documents D are aligned by an end-portion aligning member 10, for example, with a largest-page-numbered document facing a document conveyor belt 11. In order to separately convey the documents D one by one in an order starting with the document located uppermost, a sheet feed roller 12 which constitutes the sheet feed means 3 is provided in an upper portion of the document storage 2. The sheet feed roller 12 is driven by a document feed-out motor M2 to rotate in a direction indicated by an arrow at a predetermined timing, while the sheet feed roller 12 is pressed against a document D0 that is located uppermost, via a lever 13 with force of a solenoid or the like during the rotation, so that documents are separately fed out to the document feed means 7 in order, starting with the document D0.

The document feed means 7, into which the documents D are fed one by one from the document storage 2 by the sheet feed roller 12, has a conveyance path 14 bent from the horizontal to vertical direction downward as illustrated in the figure. At an inlet-side end of the conveyance path 14, separating rollers 15*a*, 15*b* are placed to prevent overlapped conveyance of the documents D. The upper roller 15*a* is driven to rotate in the document-forward direction, while the lower roller 15*b* is driven to rotate in the document-backward direction. By passing the documents D between these rollers 15*a*, 15*b*, the documents D are securely separated one by one and sent to the conveyance path 14. On the conveyance path 14, conveyor rollers 16*a*, 16*b*, 16*c*, 16*d* are provided each in a pair so as to be spaced from one another in the direction of conveyance.

Each pair of these conveyor rollers 16*a* to 16*d* rotatably contact both sides of a document D, where the rollers 16*a* to 16*d* are forcedly rotated by a document conveyor motor M3, by which the document D is conveyed along the conveyance path 14 in the direction of an arrow 17 while being guided by the rollers. A document feed sensor S2 is placed near the inlet-side end portion of the conveyance path 14, while a pre-first-reading-position sensor S3 is placed near the outlet-side end portion of the conveyance path 14.

Also, a pair of first register rollers 19*a*, 19*b* are placed at an outlet portion of the conveyance path 14 (near the first support cylinder 5). These first register rollers 19*a*, 19*b*, are linked with a drive shaft via a clutch CLT1, not shown, so as to be stopped from rotating and re-rotated by on-off control of the clutch CLT1. The on-off control of the clutch CLT1 is controlled according to a copying mode desired by the operator.

More specifically, when the document D needs to be read, the rollers 19*a*, 19*b* are stopped from rotating so that the document D is put into standby state, for synchronization with the conveyance of a recording sheet in the body 100 of the copying machine and, after synchronized, re-rotated so that the document D is conveyed to the first support cylinder 5. On the other hand, without the need of reading the document D, the first rollers 19*a*, 19*b* are normally rotated simply as conveyor rollers, like the other conveyor rollers, allowing the document D to pass therethrough.

In addition, while the first register rollers 19*a*, 19*b* operate simply as conveyor rollers, the conveyor rollers 16*c*, 16*d*, which are located upstream of the first register rollers 19*a*, 19*b* by a length less than a permissible maximum length L1 of the document D under conveyance, will not be stopped from rotating until the conveyance of the document D is completed. On the other hand, while the first register rollers 19*a*, 19*b* operate as register rollers that keep the document D on standby to adjust the timing at which the document D is conveyed to the first support cylinder 5, the conveyor rollers 16*c*, 16*d* located as described above are also controlled in rotation.

More specifically, when the conveyance-forwarded front end of the document D conveyed along the conveyance path 14 has reached between the first register rollers 19*a*, 19*b*, the conveyor rollers 16*c*, 16*d* are temporarily stopped from rotating, causing the conveyance of the document D to be stopped. Thereafter, simultaneously when the first register rollers 19*a*, 19*b* are started to rotate, the conveyor rollers 16*c*, 16*d* are also re-started to rotate, causing the conveyance of the document D to be re-started.

The position where the document image of the document D is read comprises the first reading position 20 and the second reading position 21 that are provided in correspondence to vertical lower end portions of the first support cylinder 5 and the second support cylinder 6, respectively, which are juxtaposed so as to be spaced horizontally. These first reading position 20 and second reading position 21 are on the same plane as illustrated in the figure.

The support cylinders 5, 6 are driven by document conveyor motors M4, M5, respectively, to rotate clockwise (see FIG. 2) in synchronization with the conveyance speed at which the document should be conveyed to the reading positions 20, 21 according to a copying speed to the recording sheet, i.e., according to a set scaling factor of copying. The support cylinders 5, 6 are also provided with subordinate rollers 22*a* to 22*d*, 23*a* to 23*d*, respectively, which are spaced from one another along their outer peripheral surfaces. These subordinate rollers serve to press the document D against the outer peripheral surfaces of the support cylinders 5, 6, winding the document D around the cylinders, so that the document D is conveyed along circulating conveyance paths 20*a*, 21*a* formed on the outer peripheral surfaces of the support cylinders 5, 6.

Vertically below these circulating conveyance paths 20*a*, 21*a*, hard transparent glass plates 24, 25 are placed to constitute the first and second reading positions 20, 21. When the document D passes between the first support cylinder 5 and the first transparent glass plate 24 at a speed based on a set scaling factor of copying, one surface of the document D (top surface of the documents D stacked in the document storage 2) is exposed to light and read so that the document image corresponding to the one surface is read. When the document D passes between the second reading position 21 and the second transparent glass plate 25, the other surface of the document D (bottom surface of the document D in the document storage 2) is exposed to light and read, as described later, so that the document image corresponding to the other surface is read.

In some cases of conveyance where a copying mode desired by the operator and a document-counting operation are involved, the document D will pass the first reading position 20 and the second reading position 21 as it is, without executing the reading exposure operation at those reading positions.

To the first reading position 20, the document D is conveyed as it is wound around the first support cylinder 5 by the rotational force of the first register rollers 19*a*, 19*b* via the conveyance path 14 of the document feed means 7. Between the first support cylinder 5 and the second support cylinder 6, is placed the document reversal means 8 equipped with a front-rear reversal path 30 for switching over the surface that confronts the reading position, as shown in the figure. The front-rear reversal path 30 comprises a first path 30*a* and a second path 30*b* extending upward on a slant from opposite sites of the circulating conveyance paths 20*a*, 21*a* of the first support cylinder 5 and the second support cylinder 6, and a third path 30*c* extending horizontally leftward from the junction point of these paths 30*a*, 30*b*.

At the inlet portion of the first path 30*a* adjoining the circulating conveyance path 20*a* of the first support cylinder 5, a direction switching claw 31 is placed. The direction switching claw 31 is actuated by a solenoid SOL1 so that the document D is conveyed selectively either to the first path 30*a* or to the circulating conveyance path 20*a* of the first support cylinder 5. That is, according to the copying mode desired by the operator, in which one-time exposure will do, the direction switching claw 31 is actuated to the solid-line position of FIG. 1, by which the document D that has passed the first reading position 20 is conveyed to the first path 30*a*. On the other hand, in the case where a plurality of times of reading exposure are needed, the direction switching claw 31 is actuated to the two-dot-chain-line position, by which the document D is conveyed along the circulating conveyance path 20*a* of the first support cylinder 5 to a plurality of times.

After the completion of the reading-exposure operation, the direction switching claw 31 is actuated to the solid-line position, by which the document D is conveyed to the first path 30*a*. On the first path 30*a*, there are placed a post-first-reading-position sensor S4 for sensing a conveyance-rear end portion of the document D, a pair of rollers 34*a*, 34*b*, and a direction switching claw 35, in this order starting with the upstream side in the direction of conveyance of the document D. Based on a sensing signal of the sensor S4, the following front-rear reversal operation is controlled.

By the rollers 34*a*, 34*b* being driven into rotation, the document D is conveyed through the direction switching claw 35 to the third path 30*c*. On the third path 30*c*, there are disposed conveyor rollers 36*a*, 36*b* and 37*a*, 37*b* each in a pair (Hereinafter reference numerals 36 and 37 will be used for general references). The rollers 36*a*, 37*a* are rotated forward and reverse by a document reversal motor M6. These conveyor rollers 36, 37 convey the document D derived from the direction switching claw 35 in the direction of an arrow 40*a* within the third path 30*c*, and thereafter convey the document D in the direction of an arrow 40*b* by the rotation of the document reversal motor M6 being reversed at a time point when the conveyance-rear end portion of the document D has passed the direction switching claw 35.

The direction switching claw 35 is put into the solid-line state of FIG. 1 by a solenoid SOL2, closing the first path 30*a* for the third path 30*c*, while the second path 30*b* is opened so that the document D is conveyed to the second path 30*b*. On the second path 30*b*, is disposed a roller 34*c*, which is put into press contact with the roller 34*a* by a solenoid SOL3 while the document D is sandwiched between the rollers and conveyed. The front-rear reversal operation of the document described above has been implemented by using the forward/reverse rollers 36, 37. However, the operation may be done also by using belt conveyor equipment, air conveyor equipment, or the like.

The rotational force of the rollers 34*a*, 34*c* aids the second support cylinder 6 in the operation of conveying the document D to the second reading position 21 with the document D wound around the outer peripheral surface. At a position on the downstream side of conveyance with respect to the roller 34*c*, is placed a pre-second-reading-position sensor S5 for sensing passage of the conveyance-forwarded front end portion of the document D.

Further at a position on the downstream side of the sensor S5, a pair of second register rollers 59*a*, 59*b* are disposed. These second register rollers 59*a*, 59*b*, are linked with a drive shaft via a clutch CLT2 not shown so as to be stopped from rotating and re-rotated by on-off control of a clutch CLT2. The on-off control of the clutch CLT2 is controlled according to a copying mode desired by the operator.

More specifically, when the document D needs to be read, the rollers 59*a*, 59*b* are stopped from rotating so that the document D is put into standby state, for synchronization with a recording sheet and, after synchronized, re-rotated so that the document D is conveyed to the second support cylinder 6. On the other hand, without the need of reading the document D, the rollers 59*a*, 59*b* are normally rotated simply as conveyor rollers, allowing the document D to pass therethrough without being stopped. The operation of the solenoid SOL3 is controlled according to the rotational operation of the rollers 59*a*, 59*b*.

In addition, the conveyor rollers 36, 37, which are located upstream of the second register rollers 59*a*, 59*b* by a length less than the permissible maximum length L1 of the document D under conveyance, will operate in the same relationship between the first register rollers 19*a*, 19*b* and the conveyor rollers 16*c*, 16*d*.

More specifically, while the second register rollers 59*a*, 59*b* operate simply as conveyor rollers, the conveyor rollers 36, 37, which serve to convey the document D to the second support cylinder 6, will not be stopped from rotating until the conveyance of the document D is completed. On the other hand, while the second register rollers 59*a*, 59*b* operate as register rollers, the conveyor rollers 36, 37 are temporarily stopped from rotating when the front end portion of the document D in the direction of its conveyance has reached between the rollers 59*a*, 59*b*. Thereafter, simultaneously when the second register rollers 59*a*, 59*b* are started to rotate, the conveyor rollers 36, 37 are also re-started to rotate, causing the conveyance of the document D to be re-started.

As described before, by the document D being reversed in its conveyance direction at the front-rear reversal path 30, one-side surface of the document D that has already confronted the first reading position 20, upon confronting the outer peripheral surface of the second support cylinder 6, is wound therearound, so that the document D is conveyed by the second support cylinder 6 as the other surface of the document D that has not confronted the reading position is taken as the outer surface. Accordingly, at the second reading position 21, the other surface of the document D that is conveyed at a conveyance speed based on a set scaling factor for copying is exposed to light and read, by which the document image corresponding to the other surface is read.

With regard to the second support cylinder 6, a direction switching claw 46 is placed at a site where the document D that has passed the second reading position 21 is branched from the circulating conveyance path 21*a* to a conveyance path 45 of the document storage means 9. This direction switching claw 46, which is actuated by a solenoid SOL4, selectively opens and closes the circulating conveyance path 21*a* for the conveyance path 45.

More specifically, when the reading exposure at the second reading position 21 is done only once according to the copying mode desired by the operator, the circulating conveyance path 21*a* is opened so that the document D is conveyed to the conveyance path 45. On the other hand, when the reading exposure is done to a plurality of times, the conveyance path 45 is closed while the document D is conveyed to a necessary number of times in the circulating conveyance path 21*a* and thereafter conveyed to the conveyance path 45.

As described before, one-side surface of the document D is exposed to light and read at the first reading position, and the other surface is exposed to light and read at the second reading position 21, by which images on both front and rear surfaces of the document D can be read. Also, since the reading exposure can be effected to necessary numbers of times at these first reading position 20 and second reading position 21, respectively, a necessary number of copies can be achieved with respect to a plurality of documents D.

In the document storage means 9 that returns the document D from the second reading position 21 to the document storage 2, the conveyance path 45 connects with the lower end portion of the conveyor belt 11 so that the document D is conveyed to the conveyor belt 11. That is, the conveyance path 45 has conveyor rollers 50, 51, each in a pair, provided for conveying the document D. Also near the outlet of the conveyance path 45, a pre-storage document sensor S6 for sensing passage of the document D is disposed. Based on a sensing signal derived from the sensor S6, the operation control of the conveyor belt 11 and the document storage means 9 is executed.

The endless conveyor belt 11 is wound on and stretched over rollers 55*a*, 55*b*, 55*c*, 55*d*, which are spaced from one another vertically and horizontally as shown in the figure. The drive roller 55*b* is driven to rotate in a direction of an arrow by a return conveyor motor M7 based on the sensing signal from the sensor S6, by which the conveyor belt 11 is driven to rotate counterclockwise (see FIG. 2). The upper stretched portion of the conveyor belt 11 serves also as a portion on which the document D is placed. Further, a document-introducing roller 56 is placed in proximity to the conveyance path 45, so that the document D is fed in between the upper stretched portion of the conveyor belt 11 and the lowermost portion of the document D placed thereon, by the conveying force in cooperation of the conveyor belt 11 to the roller 56.

In connection to this, for more smooth feed-in operation, a document kick-up roller 58 is disposed below a document-feed downstream-side end portion of the documents D placed in the document storage 2. This arrangement makes a right-side end portion, as viewed in the figure, of the stacked documents D temporarily floated off the conveyor belt 11, thus positively widening the opening for feeding each document to the lowermost end position. When the conveyance-forwarded front end portion of the document D has reached the end-portion aligning member 10, the return conveyor motor M7 of the conveyor belt 11 is stopped from being driven, by which the returning operation of the document D, which has been fed to the lowermost end position, is completed.

Further, in the document storage 2, a detective actuator member 60 made of, for example, a mirror-finished stainless steel plate or the like is provided to detect one circulation of the placed documents D, as shown in the figure. The actuator member 60 is in a lower end position indicated by solid line in FIG. 1 before the operator places the documents D, and then the documents D are placed on the actuator member 60. The documents D are fed out from the document storage 2 one by one, and as the documents D are returned again, the actuator member 60 is displaced gradually upward, intervening between un-fed documents and re-stored documents to thereby distinguish between the two. Upon one circulation of all the documents D, the actuator member 60 reaches the top position indicated by two-dot chain line.

The actuator member 60 that has reached the top position is subject to a detection of exposed state by a document one-circulation detector Si comprising, for example, a light-emitting device or a combination of light-emitting devices within the document storage 2, where the actuator member 60 generates a detection signal showing that one circulation has been completed. With this detection signal, the operation on the copying machine body 100 side such as effecting copying operation to only a number of copies desired by the operator is controlled. Thereafter, the actuator member 60 is driven to rotate 180° by an actuator-member drive motor M1, thus being returned to the lower-side position with respect to the documents D (original position).

Referring again to FIG. 1, in an upper portion inside the body 100 of the copying machine, there is provided exposure means 149 for exposing to light the surface of a document through a slit, including a light source 150, reflectors 151*a*, 151*b*, 151*c*, 151*d*, and a zoom lens 152. In this exposure means 149, when a light-source beam of light from the light source 150 is applied to the document surface of a document D, its reflected light showing a document image passes through the reflectors 151*a* to 151*d* and the lens 152, forming an image at an exposure region 130 of the photoconductor 101.

The exposure means 149 performs the reading exposure process, with a first mobile member 71 stopped, at the first reading position 20 just below the first support cylinder 5 and the second reading position 21 just below the second support cylinder 6, responsive to the conveyance of the document D at a conveyance speed based on the copying scaling factor in the document handler 1. Also, in a case where a book or the like is placed at the third reading position 105, the first mobile member 71 having the light source 150 and the reflector 151*a* performs the reading exposure process while scanning the third reading position 105. These two processes of read exposure are accomplished by driving the exposure means 149 with a drive motor M13. Position detectors S7 to S9 detects placement of the first mobile member 71 in the reading positions 20, 21, and 105, respectively.

As the photoconductor 101 is driven into clockwise rotation at a constant speed, the photoconductor 101 is electrically charged first by a corona discharger 102 for charging. The reflected light that has passed through the exposure means 149 at the exposure region 130 forms an image on the charged photoconductor 101, where an electrostatic latent image corresponding to the read document image is formed. The resulting electrostatic latent image is developed into a toner image by the developing unit 103. This toner image is transferred to a recording sheet P fed to the photoconductor 101 as described later, in a transfer region 129 by a corona discharger 131 serving for transfer. The recording sheet P after the transfer is conveyed to the fixing unit 104 by conveyor means 132, where the recording sheet P is subject to a fixing process.

In addition, after the transfer process in the transfer region 129, the toner remaining on the photoconductor 101 is removed by a cleaning unit 133 placed downstream of the transfer region 129 in the direction of rotation of the photoconductor 101. Thereafter, residual charges on the photoconductor 101 are dissipated by an eraser 134, and subsequently the surface of the photoconductor 101 is charged by the charging-use corona discharger 102 to form an electrostatic latent image.

Sheet feeder cassettes 106*a*, 106*b* in which recording sheets P are stored are loaded on one side of the body 100 of the copying machine, while sheet feeder cassettes 106*c*, 106*d* are also loaded in a lower portion of the body 100. The recording sheets P stacked in the sheet feeder cassettes 106*a* to 106*d* are picked up one by one in an order starting with the one located uppermost, and then fed to sheet feed paths 108*a* to 108*d*. This sheet-feeding operation is carried out by sheet feed rollers 109*a* to 109*d*, which are disposed at the top surfaces of the sheet feeder cassettes 106*a* to 106*d*, being rotationally driven by a sheet-feed drive motor M8. On the sheet feed paths 108*a* to 108*d* and a sheet feed path 115 derived from a later-described intermediate tray 113, are provided sheet conveyor rollers 107*a* to 107*e*, which are rotationally driven by a drive motor M9 so that the recording sheets P are fed to the copying-process sections described above.

The recording sheets P fed and conveyed from the sheet feeder cassettes 106*a* to 106*b* and the intermediate tray 113 are controlled in the timing of their conveyance to the photoconductor 101 by third register rollers 160*a*, 160*b* (hereinafter, indicated by reference numeral 160 for generic reference), which are located on the way of conveyance paths to the photoconductor 101. That is, when the conveyance-front end portion of the recording sheet P conveyed to the photoconductor 101 has reached between the third register rollers 160*a*, 160*b*, the recording sheet P is temporarily stopped from conveyance.

In the case where the reading exposure of one surface of the document D is done at the first reading position 20, the first register rollers 19*a*, 19*b* within the document handler 1 operate as register rollers that control the conveyance of the document D, while the second register rollers 59*a*, 59*b* operate simply as conveyor rollers. After a temporary stop of the document D at the first register rollers 19*a*, 19*b* or a temporary stop of the recording sheet P at the third register rollers 160*a*, 160*b*, for example, the first register rollers 19*a*, 19*b* are driven to rotate so that the document D is started to be conveyed and then, after the lapse of a predetermined set time period, the third register rollers 160*a*, 160*b* are driven to rotate so that the recording sheet P is started to be conveyed.

This set time is set to a time period that results from subtracting the time which elapses since the recording sheet P is started to be conveyed from the third register rollers 160*a*, 160*b* until its conveyance-front end portion reaches the transfer region 129, from the time which elapses since the document D is started to be conveyed by the first register rollers 19*a*, 19*b* and then exposed and read at the first reading position 20 as described before until the travel-downstream-side end portion of the toner image formed on the photoconductor 101 in correspondence to the document image reaches the transfer region 129. The resulting set time is counted, for example, by a timer or the like in the control unit. Therefore, alignment of the transferred image with respect to the recording sheet P can be reliably accomplished by attaining synchronization as described above.

Also, in the case where the reading exposure of the other surface of the document D is done at the second reading position 21, the first register rollers 19*a*, 19*b* operate simply as register rollers, while the second register rollers 59*a*, 59*b* operate as register rollers. The relationship between the timing at which the document D is conveyed by the second register rollers 59*a*, 59*b* and the timing at which the recording sheet P is conveyed by the third register rollers 160*a*, 160*b* is set in the same manner as the relationship of synchronization between the first register rollers 19*a*, 19*b* and the third register rollers 160*a*, 160*b*. In addition, the rotation/stop control of the third register rollers 160*a*, 160*b* as described above is implemented by the on/off control of a recording-sheet conveyance clutch CLT3 intervened against drive motors.

On the other side face of the body 100 of the copying machine, is disposed an ejection tray 110. This ejection tray 110 is equipped with a solenoid SOL8. When the solenoid SOL8 is energized for a specified time period, the ejection tray 110 is operated to shift forward. When the solenoid SOL8 is de-energized for a specified time period, the ejection tray 110 is operated to shift in an opposite direction when SOL8 is energized. As a result, the ejection tray 110 is enabled to receive a plurality of sets of recording sheets to which a plurality of documents have been copied, as the sets of recording sheets have been grouped.

In the body 100, are provided an ejection path 111 for ejecting to the ejection tray 110 the recording sheet P that has passed the fixing unit 104 over the copying process, and a recording-sheet front-rear reversal path 112 that has been branched from the ejection path 111. There recording sheet P, which has been subject to the copying process and the proccess of the fixing unit 104 has one surface which contains a copy corresponding to the document image, is ejected to the ejection tray 110 according to a copying mode desired by the operator for example in the following three modes of (1) to (3):

(1) The recording sheet P passes through the ejection path 111 as it is, and is ejected to the ejection path 111.

(2) After directed toward the ejection path 111, the recording sheet P is switched back at the recording-sheet front-rear reversal path 112 for a copying process on the other surface of the recording sheet P, and then temporarily stored in the intermediate tray 113 for the conveyance to the copying process once again. Recording sheets P stacked on the intermediate tray 113 are fed, in an order starting with the lowermost-located one, to the copying process section via the conveyance path 115 by a sheet feed means 114 rotationally driven by a motor M14, passing through the fixing unit 104, and through the ejection path 111, being ejected to the ejection tray 110.

(3) After directed toward the ejection path 111, the recording sheet P is reversed in the recording-sheet front-rear reversal path 112 and then ejected to the ejection tray 110 through the ejection path 111.

In order to enable the above three kinds of conveying operation of recording sheets P, the recording-sheet front-rear reversal path 112 comprises paths 112*a*, 112*b* branched from two positions of the ejection path 111, a path 112*c* at which these paths 112*a*, 112*b* join together, and a path 112*d* branched from the path 112*c* and directed toward the intermediate tray 113. A first direction-switching claw 115 is disposed at the site where the path 112*a* is branched from the ejection path 111, a second direction-switching claw 116 is disposed at the site where the path 112*a* and the path 112*b* join together, and a third direction-switching claw 117 is disposed at the site where the path 112*c* and the path 112*d* are branched from each other. These first to third direction-switching claws 115 to 117 are actuated by solenoids SOL5, SOL6, SOL7 (not shown), respectively, by which a conveyance path for recording sheets P is selected according to a copying mode desired by the operator.

Rollers 118*a*, 118*b*, 118*c* are disposed in proximity to the site where the path 112*a* and the path 112*b* join together, and rollers 119*a*, 119*b*, 119*c* are disposed in proximity to the site where the path 112*c* and the path 112*d* are branched from each other, the rollers each serving to convey the recording sheet P. Also, a reversal roller 120 is disposed on the path 112*c* in proximity to the site where the path 112*a* and the path 112*b* join together, the reversal roller 120 being rotated forward and reverse by an unshown drive motor M11 so as to reverse the direction in which the recording sheet P is conveyed. A reversal roller 121 is disposed below the site where the path 112*c* and the path 112*d* are branched from each other, the reversal roller 121 being rotated forward and reverse by an unshown drive motor M12. Further, an ejection sensor S13 is disposed in proximity to the outlet of the ejection path 111, recording-sheet reversal sensors S14, S15 are disposed in proximity to the inlet of the path 112*a* and on the path 112*c*, and besides an intermediate-tray inlet sensor S16 is disposed in proximity to the outlet of the path 112*d*.

With the above configuration of the recording-sheet front-rear reversal path 112, in the case of the ejection mode (1), the path 112*a* is closed for the ejection path 111 by the first direction-switching claw 115, so that the recording sheet P is ejected along the ejection path 111. In the case of mode (2), the ejection path 111 is closed by the first direction-switching claw 115 so that the recording sheet P is led into the path 112*a*, the path 112*c* is opened by the second direction-switching claw 116, and the direction of conveyance is reversed by the reversal roller 121 on the path 112*c*. Thereafter, the path 112*d* is opened by the third direction-switching claw 117, so that the recording sheet P is led out to the intermediate tray 113. In the case of mode (3), after the recording sheet P is led into the path 112*c* as described above, the direction of conveyance is reversed by the reversal roller 120, the path 112*a* is closed by the second direction-switching claw 116, while the path 112*b* is opened so that the recording sheet P is led out from the path 112*b* to the ejection path 111.

In the present copying machine, in order to detect the conveyance state of the recording sheet P at the individual sites shown in FIG. 1, there are provided a recording-sheet feed sensor S10, a recording-sheet pre-transfer sensor S11, a post-fixing sensor S12, an in-intermediate-tray sheet's presence/absence sensor S17, an intermediate-tray sheet feed sensor S18, and the like.

The copying machine equipped with the above-described recirculating automatic document handler 1 is enabled to freely carry out a copying process by circulating the document to any plurality of times in any of the modes including: (A) one-sided document to one-sided copy with the result of a plurality of grouped sets; (B) one-sided document to double-sided copy with the result of a plurality of grouped sets; (C) double-sided document to one-sided copy with the result of a plurality of grouped sets; and (D) double-sided document to double-sided copy with the result of a plurality of grouped sets, depending on the copying mode desired by the operator.

Also, depending on the copying mode desired by the operator, the copying of a plurality of sheets may be done during one circulation of a document by effecting the reading and exposure process with the document kept wound around the support cylinder to a plurality of times.

Further, the register rollers 19*a*, 19*b*, 59*a*, 59*b*, the individual conveyor rollers and the like provided at the support cylinders 5, 6 and on the way of conveyance before and after the support cylinders 5, 6, respectively, are controlled in their rotational speed based on a set scaling factor for copying, by which the scaling factor of the document image to be read onto the photoconductor 101 that is rotationally driven at a constant speed is restricted. Thus, it is enabled to copy the document image to the recording sheet at a desired size out of the real-size mode, the scale-down mode, and the scale-up mode. In more detail, with the conveyance speed of the document D to the reading positions 20, 21 in the real-size mode used as the reference, in the scale-down mode, the support cylinders 5, 6 and the register rollers and the like are controlled so that their rotational speed is sped up responsive to the scaling-down factor, where the conveyance speed at which the document D is conveyed through the reading positions 20, 21 is sped up. By contrast, in the scale-up mode, the support cylinders 5, 6 and the register rollers and the like are controlled so that their rotational speed is slowed down responsive to the scaling-up factor, where the conveyance speed at which the document D is conveyed through the reading positions 20, 21 is slowed down.

Out of the various copying modes, in the copying mode of (B) one-sided document to double-sided copy, since the control method differs depending on whether the number of documents is odd or even, the operation of counting the documents D is effected beforehand prior to the copying operation in the copying mode, where it is determined whether the number of documents is odd or even. In this embodiment, the counting operation is automatically carried out by the recirculating document handler 1.

More specifically, documents D that have previously been stacked and placed for copying in the document storage 2 are fed successively to the conveyance paths. Then, the register rollers 19*a*, 19*b*, 59*a*, 59*b* are made to serve simply as conveyor rollers, and the documents D, passing through the first support cylinder 5, the document reversal means 8, and further the second support cylinder 6, are thus re-stored in the document storage 2 by the conveyor belt 11. In this way, all the documents D that had been placed on the document storage 2 are circulated to one cycle along the conveyance paths, where the number of conveyed documents D can be counted by either one of the optical sensors S2 to S6 disposed in proximity to the conveyance paths. The one circulation of all the documents is detected by the document one-circulation detector S1.

Figure 3:
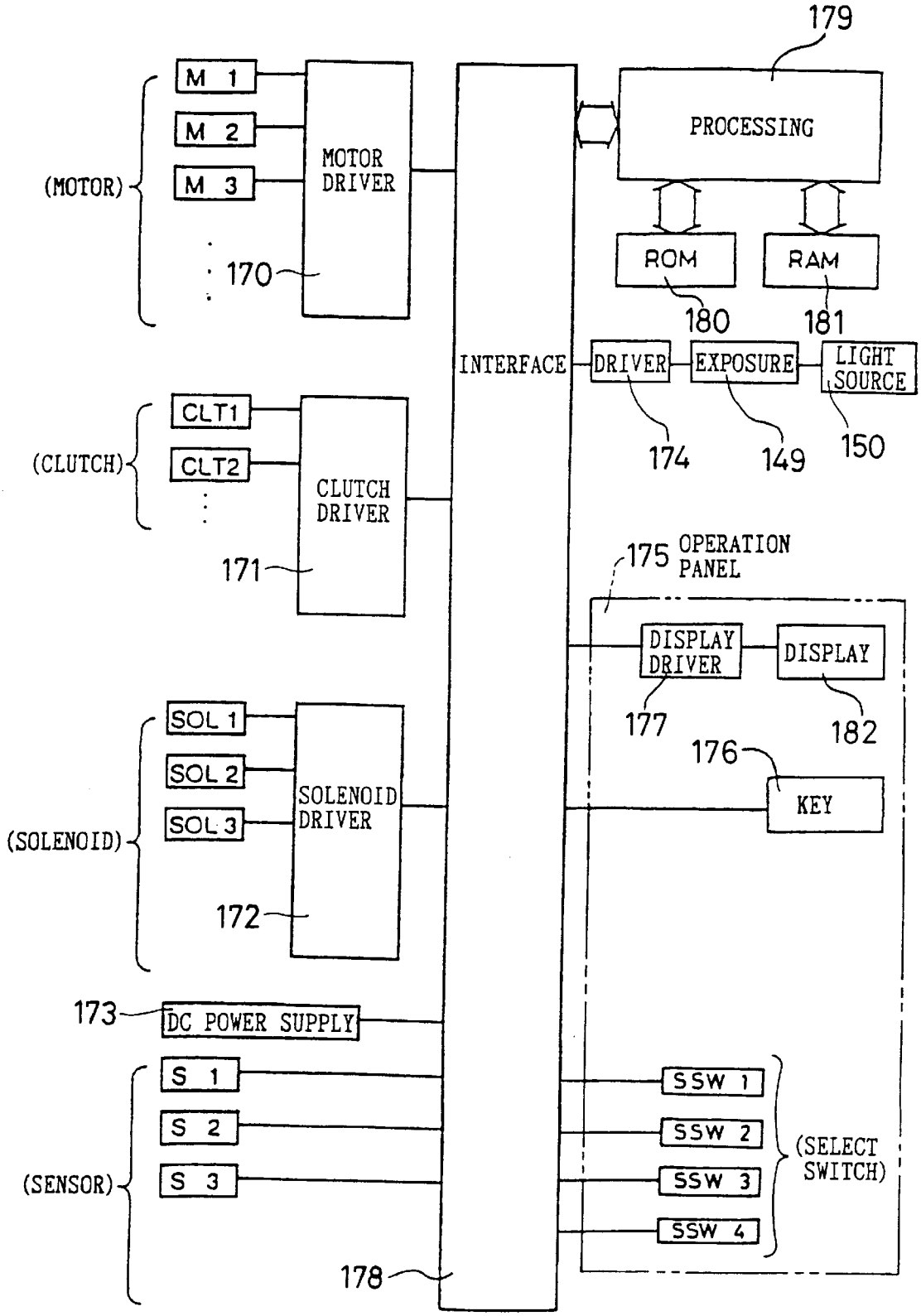
FIG. 3 is a block diagram of a controlling system of FIG. 1.

FIG. 3 is a block diagram showing the electrical configuration of a control unit that controls the copying machine 100 and the document handler 1. The motors M1, M2, M3, . . . etc. that operate the conveyor rollers, the support cylinders and the like are connected to a motor drive circuit 170. The clutches CLT1, CLT2, CLT3, . . . etc. that are used for synchronization between a document D conveyed within the document handler 1 and a recording sheet P conveyed within the body 100 of the copying machine are connected to a clutch drive circuit 171. The solenoids SOL1, SOL2, . . . etc. that actuate the direction switching claw 31, 35 and the like on the conveyance paths are connected to a solenoid drive circuit 172.

These drive circuits 170 to 172 are connected to an interface circuit 178 together with DC power supply 173, the sensors S1, S2, S3, . . . etc. for detecting the conveyance state of documents D and recording sheets P, an optical-system drive circuit 174 which moves the exposure means 149, the input operation key 176 on the operation panel 175 provided on the body 100 of the copying machine, a display drive circuit 177 for driving the display unit 182 on the operation panel 175, and the like.

The interface circuit 178 is connected to a processing circuit 179 implemented by a microcomputer or the like, and serves for transmitting sensing signals from the sensors to the processing circuit 179 and for feeding control signals derived from the processing circuit 179 to the various motor drive circuits 170, 171, 172, 174, 177. To the processing circuit 179, are connected a read-only memory (ROM) 180 and a random-access memory (RAM) 181. The processing circuit 179 performs the control of copying operation according to control programs that have previously been stored in the memory 180. The memory 181 is used, for example, as computing areas for counters, timers, flags, and others required for the control of copying operation.

The interface circuit 178 moves the exposure means 149 via the optical-system drive circuit 174 to control the turn-on/off and lighting level of the light source 150 at the individual reading positions 20, 21, 105. Further, the interface circuit 178 transmits the signal derived from the input operation key 176 on the operation panel 175 to the processing circuit 179, and makes information on the progress of the copying operation and the like displayed by the display unit 182 provided on the operation panel 175 via the display drive circuit 177. Part of the input operation key 176 allows the operator to set a scaling factor and the like.

Furthermore, to the interface circuit 178, are connected selector switches SSW1 to SSW4 for selecting a copying mode, as part of the operation panel 175. Available copying modes include the modes of one-sided document to one-sided copy, one-sided document to double-sided copy, double-sided document to one-sided copy, double-sided document to double-sided copy, and the like.

The processing circuit 179, which is control means, controls the rotational speeds of the support cylinders 5, 6 for conveying the documents D in the recirculating document handler 1 and of the motors M3 to M6 for driving the conveyor rollers, based on the scaling factor for copying set by the input operation key 176. Also, from the copying mode selected by the selector switches SSW1 to SSW4, the processing circuit 179 decides whether or not the counting operation is necessary, and performs a control process during the counting operation so that the motors M3 to M6 come to a rotational speed based on the maximum conveyance speed, thus reducing the time spent for idle conveyance of the document D during the counting operation.

The conveyance speed control of the document during the counting operation may be rough, compared with the conveyance speed control of the document during the copying operation. Thus, high speed conveyance is enabled without any new speed control circuit.

Figure 4:
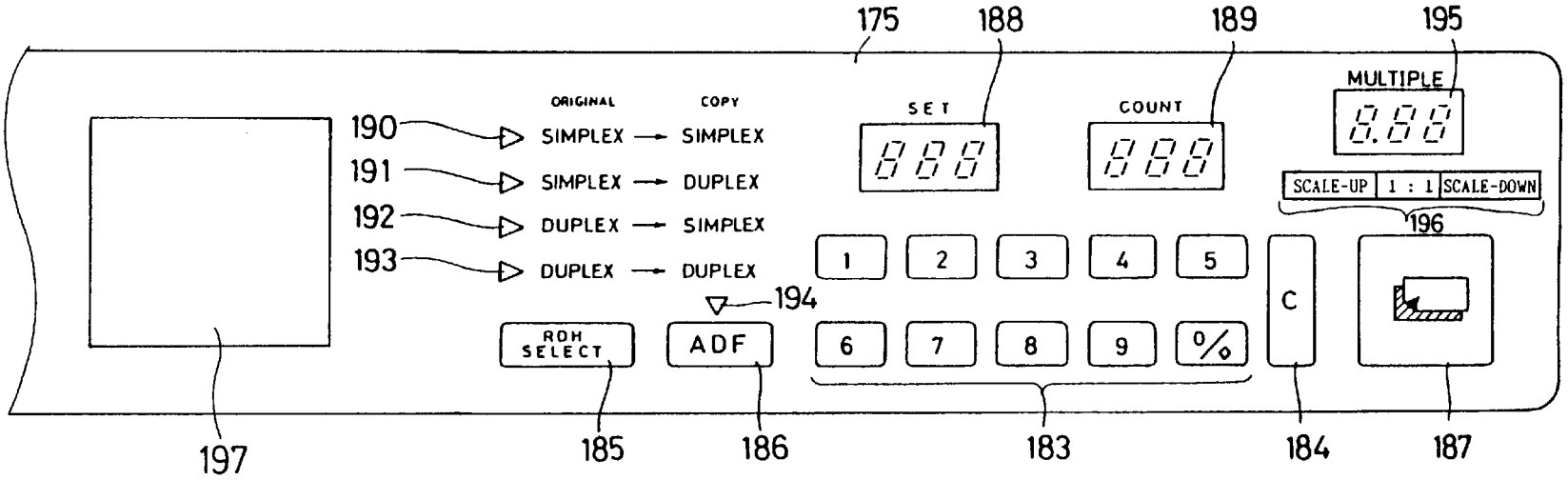
FIG. 4 is a plane view of an operation panel of FIG. 1.

FIG. 4 is a plan view showing part of the arrangement of the operation panel 175 such as the input operation key 176 and the display unit 182. The operation panel 175 has a number-setting key 183 for setting a number of copies or the like, a clear key 184, a select key 185 for setting a copying mode, an ADF key 186 to be operated when the copying is carried out with the document fixed and by moving and scanning the optical system, a print switch 187 for instructing a start of copying operation, a set number-of-copies display 188, a copy-count display 189, copying-mode displays 190 to 193 with the use of the document handler 1, an ADF display 194 for showing the reading-exposure operation state with the optical system driven into travel, a scaling-factor display 195, a scaling-factor setting key 196 for setting a copying scaling factor, and a display 197 for displaying messages or the like.

The copying-mode displays 190 to 193 showing four kinds of copying modes: one-sided document to one-sided copy (simplex—simplex), one-sided document to double-sided copy (simplex-duplex), double-sided document to one-sided copy (duplex-simplex), and double-sided document to double-sided copy (duplex—duplex), respectively. Each time the select key 185 is pressed once, one light-emitting device will light by turns, for example starting with the uppermost, by which a corresponding copying mode is selected. The lowermost position turns back to the uppermost position again, and the initial state returns to the uppermost position, where their corresponding copying modes are selected, respectively. The set number of copies is set by pressing the number-setting key 183 and displayed by the set number-of-copies display 188, which is implemented, for example, by a plurality of 7-segment displays.

In the case of copying in which the document handler 1 is not used, for example, in the case of copying of a bound book or the like, the light-emitting device of the ADF display 194 is lit by pressing the ADF key 186, where a copying mode in which the reading-exposure operation is executed on the original document placed still at the third reading position 105 by driving the exposure means 149 into transverse is selected. In a copying mode selected by the operator, the scaling factor is set to a desired one in the real-size mode, the scale-up mode and the scale-down mode by operating the scaling-factor setting key 196. The set scaling factor is displayed by the scaling-factor display 195.

When the copying operation is started by the print switch 187 being pressed, the number of copies achieved is displayed by turns in the copy-count display 189. Upon coincidence of the set number of copies displayed in the set number-of-copies display 188 with the copy count, the copying operation stops, where the display of the set number of copies automatically returns to a "0" display. The display of the copy count is maintained, for example, until the print switch 187 is pressed next.

The intermediate tray 113 has a rear end Guide B, which is accompanied with a cycle detecting lever LV1 and a cycle detecting sensor S19.

FIGS. 5 to 9 are diagrams for explaining the movement of the lever LV1. A reference letter P denotes one-side copied sheets stored in the intermediate tray, A1 an arm for supporting the lever LV1, SP1 a plate spring, and G1 a lever movement guide.

A reference name SOL1 shows a solenoid for the movement of the detecting lever, and is engaged with the arm A1.

Figure 5:
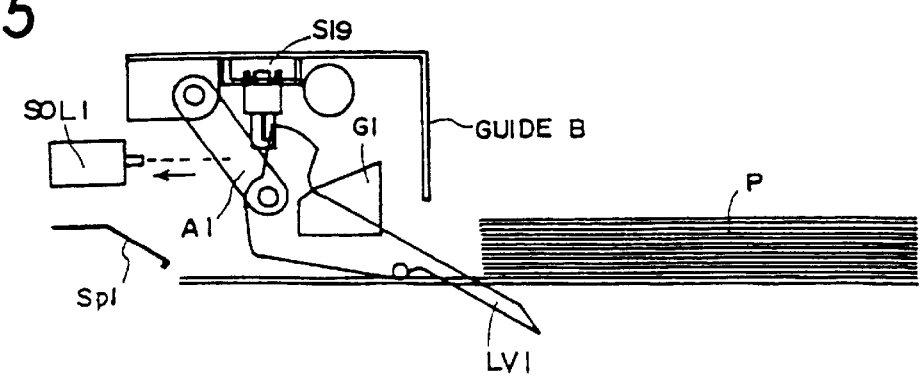
FIG. 5 is a view showing a first operation state of a cycle detecting lever of FIG. 1.
Figure 6:
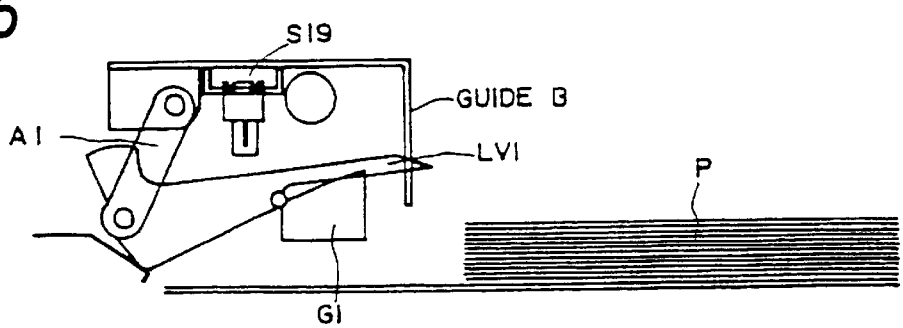
FIG. 6 is a view showing a second operation state of the cycle detecting lever of FIG. 1.
Figure 7:
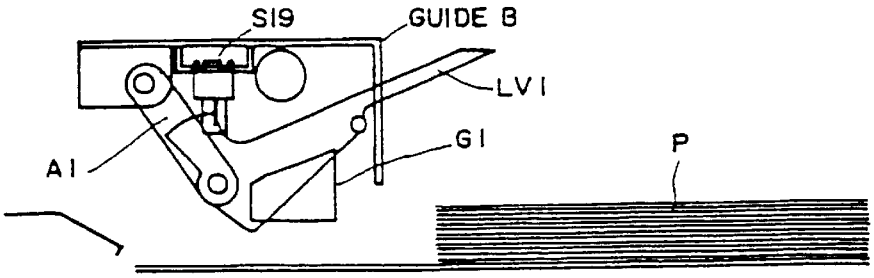
FIG. 7 is a view showing a third operation state of the cycle detecting lever of FIG. 1.
Figure 8:
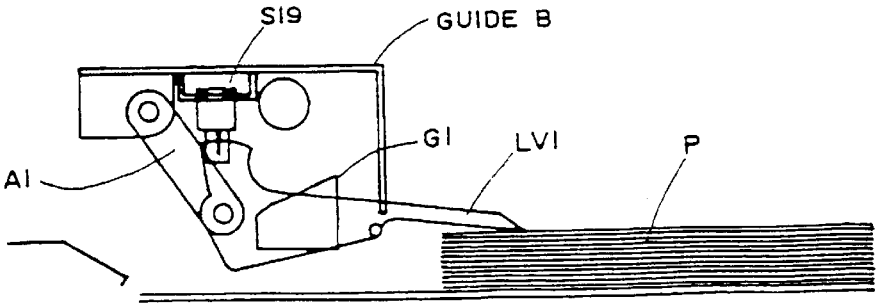
FIG. 8 is a view showing a fourth operation state of the cycle detecting lever of FIG. 1.

In FIG. 5, at first, when A1 is pulled by the solenoid SOL1 in the direction of the arrow, the end of the lever LV1 is turned upward by the plate spring as shown in FIG. 6. Then, when the solenoid is turned off after a fixed interval, the lever LV1 is moved upward along its track by the guide G1 as shown in FIG. 7, and placed on the one-sided copied sheets P1 as illustrated in FIG. 8.

Figure 9:
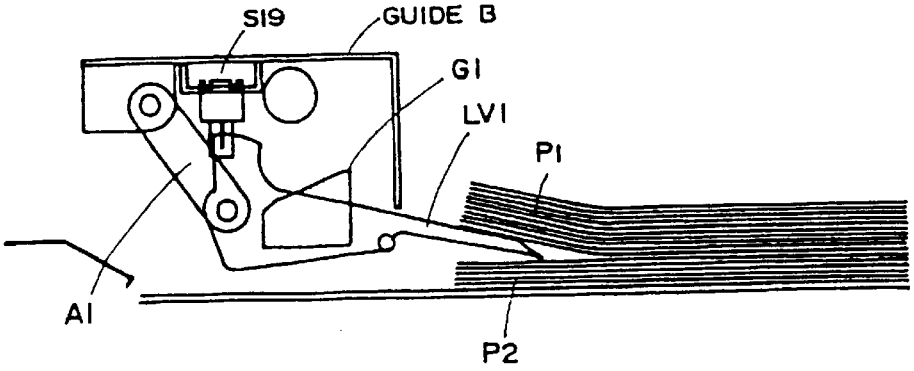
FIG. 9 is a view showing a fifth operation state of the cycle detecting lever of FIG. 1.

In addition, when the one-sided copied sheets enters the intermediate tray from the upper side, the lever moves downward due to its own weight and acts as a separator between sets of copied sheets as shown in FIG. 9. At this time, the position of the lever is detected from the state of the sensor S19. Namely, the photo sensor S19 detects the lever position from a light-shielding plate disposed on the end of the lever LV1. Accordingly, the lever position in FIG. 5 shows the cycle detecting state and those in FIGS. 8 and 9 show the cycle detecting state.

FIGS. 20 and 23 through 30 are diagrams for explaining the transporting operation (a non-skip mode) of the copying machine in the embodiment of the invention. The document handler 1 continuously feeds the stored documents one by one to the predetermined image reading positions, and stores the documents again after the completion of reading. With the document handler 1, assists to accomplish a transfer of an image from a one-sided document onto both sides of a recording sheet and to perform such a transfer for a plurality of sets of copies.

Figure 25:
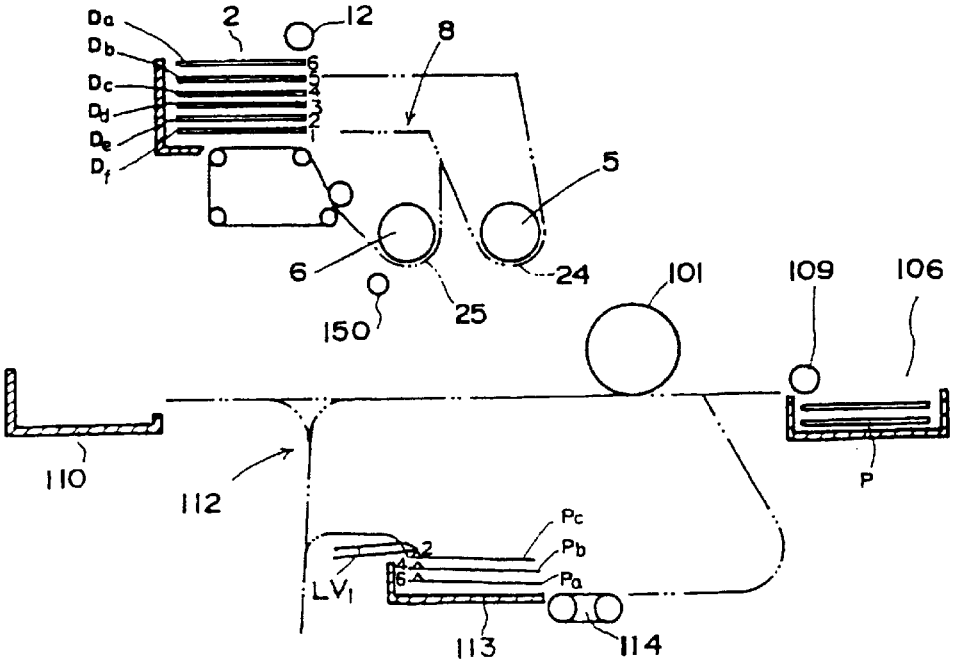
FIG. 25 is a view showing a third operation state of the copying machine of the present invention in S→D mode.
Figure 26:
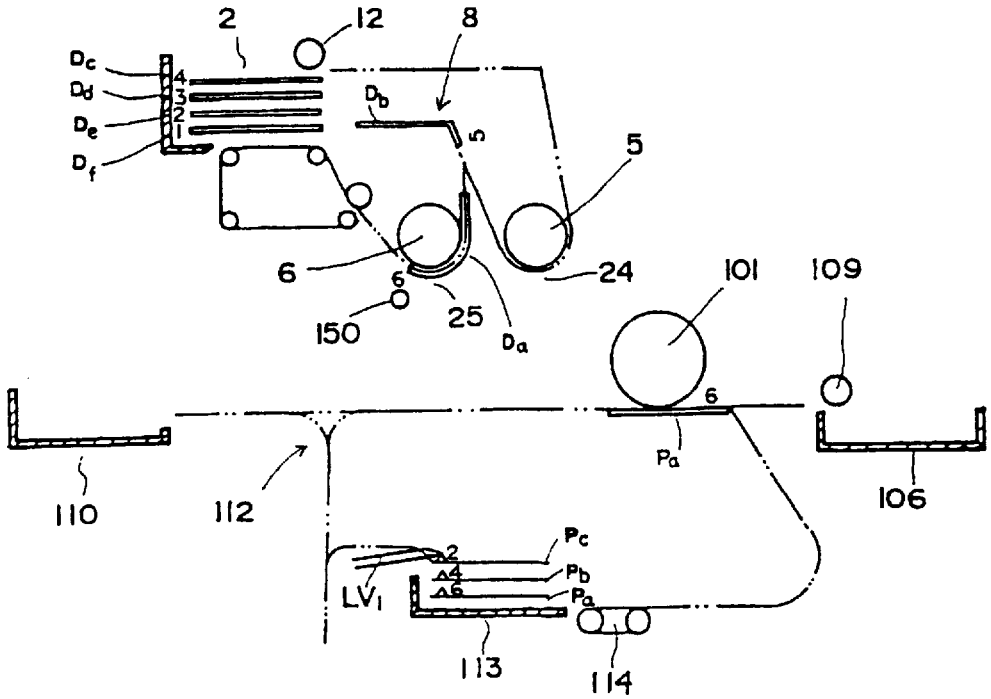
FIG. 26 is a view showing a fourth operation state of the copying machine of the present invention in S→D mode.

As an example, take a case where recording sheets P stored in the cassette 106*a* are used and where six original documents are copied for two sets, in the first circulation of documents, the sheet feed roller 109*a* is driven so that the recording sheets stored in the cassette 106*a* are fed one by one. The register roller 160 is driven so that a fed recording sheet is given to the photoconductor 101. Images drawn on either odd or even numbered ones of the six documents are fed by the document handler 1. For example, on the even numbered documents, the even numbered documents are transferred to one-side surfaces of the fed recording sheets (FIG. 24) and then the recording sheets on one-side surfaces of which the images have been transferred are stored in the intermediate tray 113. Meanwhile, the odd numbered documents are idly transferred without image transfer (FIG. 25).

Figure 27:
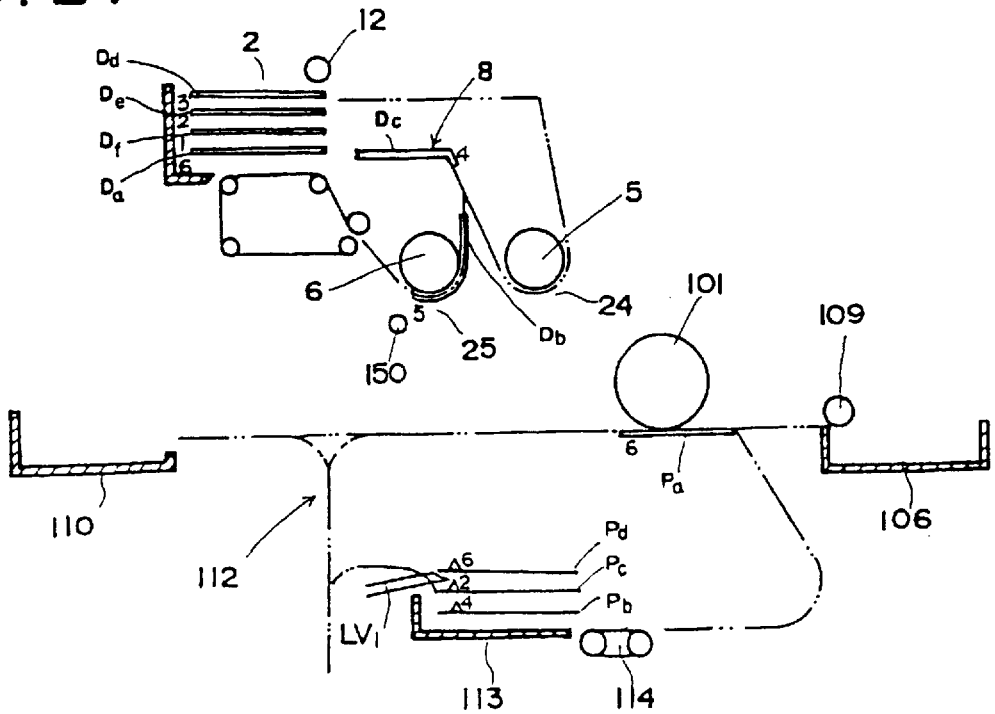
FIG. 27 is a view showing a fifth operation state of the copying machine of the present invention in S→D mode.
Figure 28:
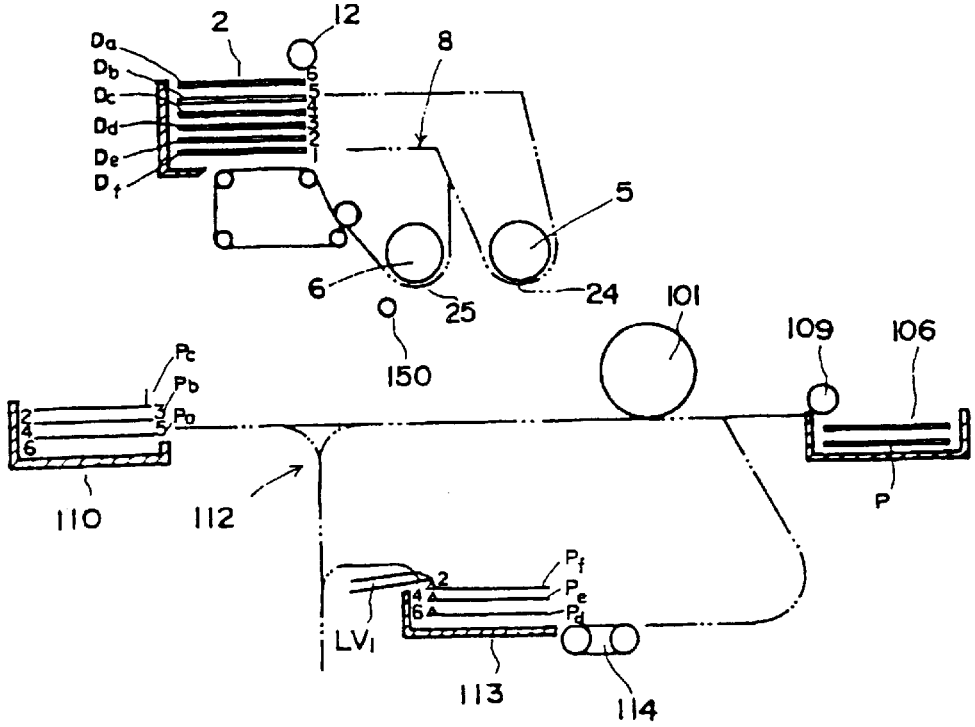
FIG. 28 is a view showing a sixth operation state of the copying machine of the present invention in S→D mode.

In the second and following circulations of the documents, the image drawn on the first-page document is transferred to one-side surface of the recording sheet P fed from the cassette 106*a* (FIG. 26), while the image drawn on the second-page document is transferred to the other-side surface of the recording sheet which is fed from the intermediate tray 113 (FIG. 27). By repeating such a transfer operation, the images of the six documents are transferred. Recording sheets on one-side surface of which images have been transferred are stored in the intermediate tray 113, while recording sheets on both-side surfaces of which images have been transferred are ejected to the ejection tray 110 (FIG. 28).

Figure 29:
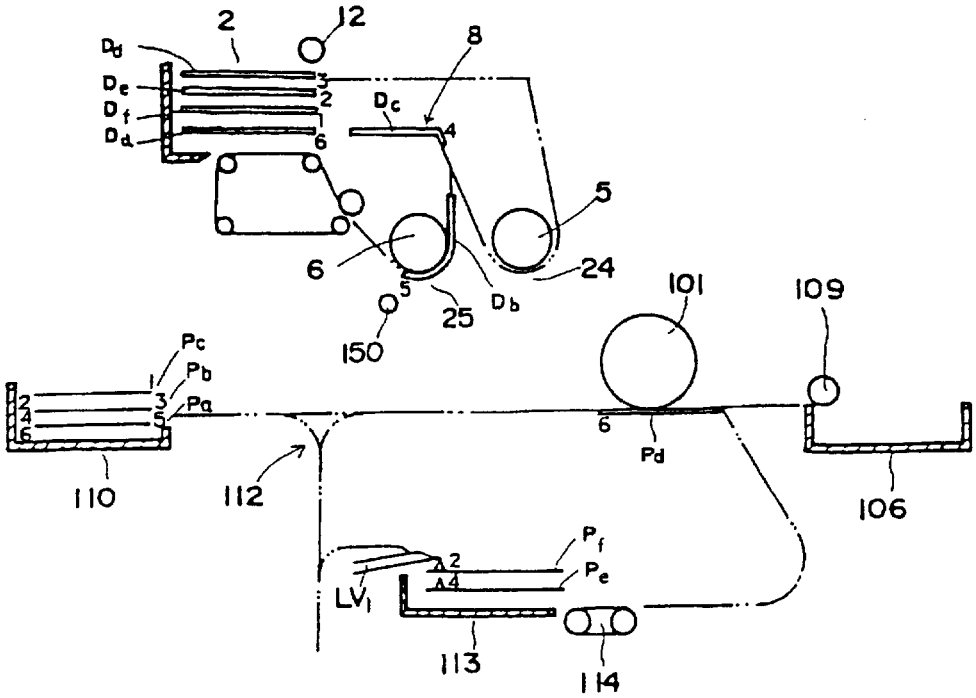
FIG. 29 is a view showing a seventh operation state of the copying machine of the present invention in S→D mode.
Figure 30:
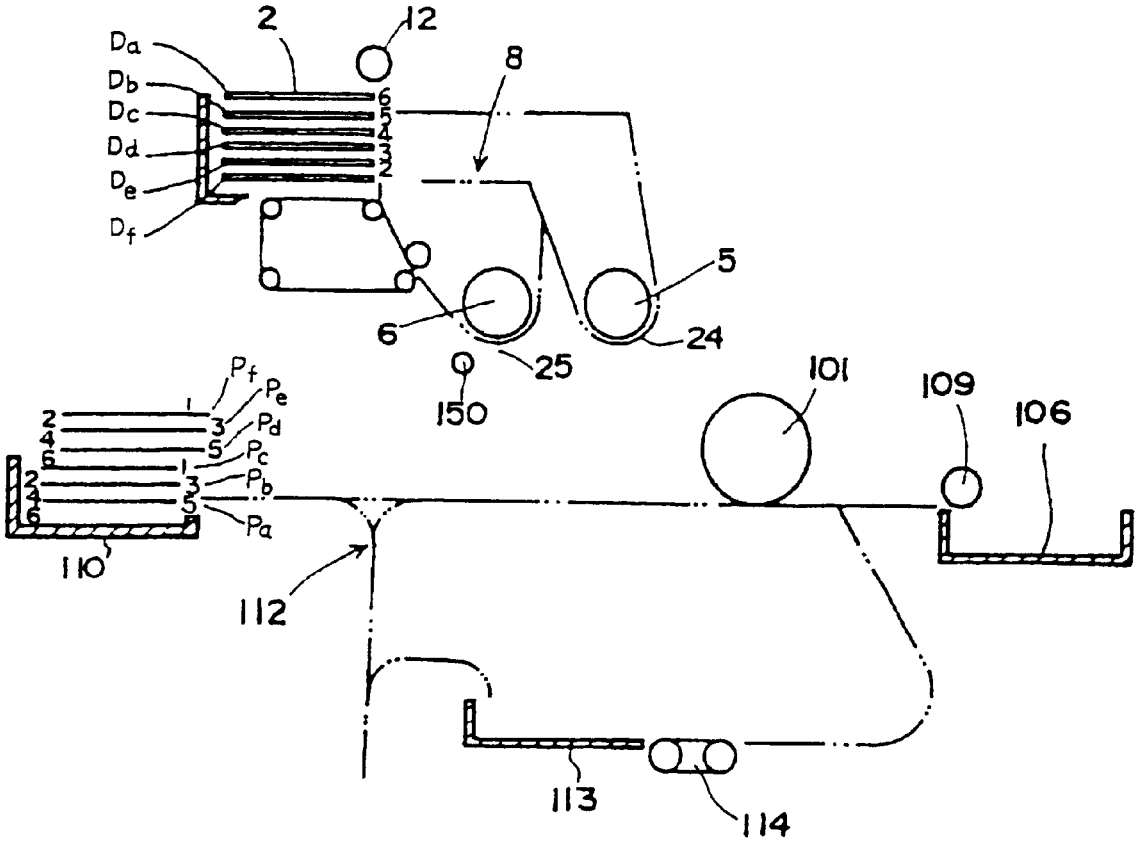
FIG. 30 is a view showing an eighth operation state of the copying machine of the present invention in S→D mode.

In the final circulation of the documents (the third circulation), the sheet feed roller 114 is driven so that the recording sheets stored in the intermediate tray 113 are fed one by one. The register roller 160 is driven so that a fed recording sheet is given to the photoconductor 101. Images drawn on the other documents, namely odd or even numbered documents of the documents fed by the document handler 1, for example, on odd numbered documents are transferred to the other-side surfaces of the recording sheets (FIG. 29). Then, the recording sheets on both-side surfaces of which images have been transferred is ejected to the ejection tray 110. Meanwhile, the even numbered documents are idly transferred. In this way, images are transferred from documents on one-side surfaces of which images have been drawn, to both-side surfaces of recording sheets, and besides such a transfer process can be executed for apparatus of copies (FIG. 30).

Figure 20:
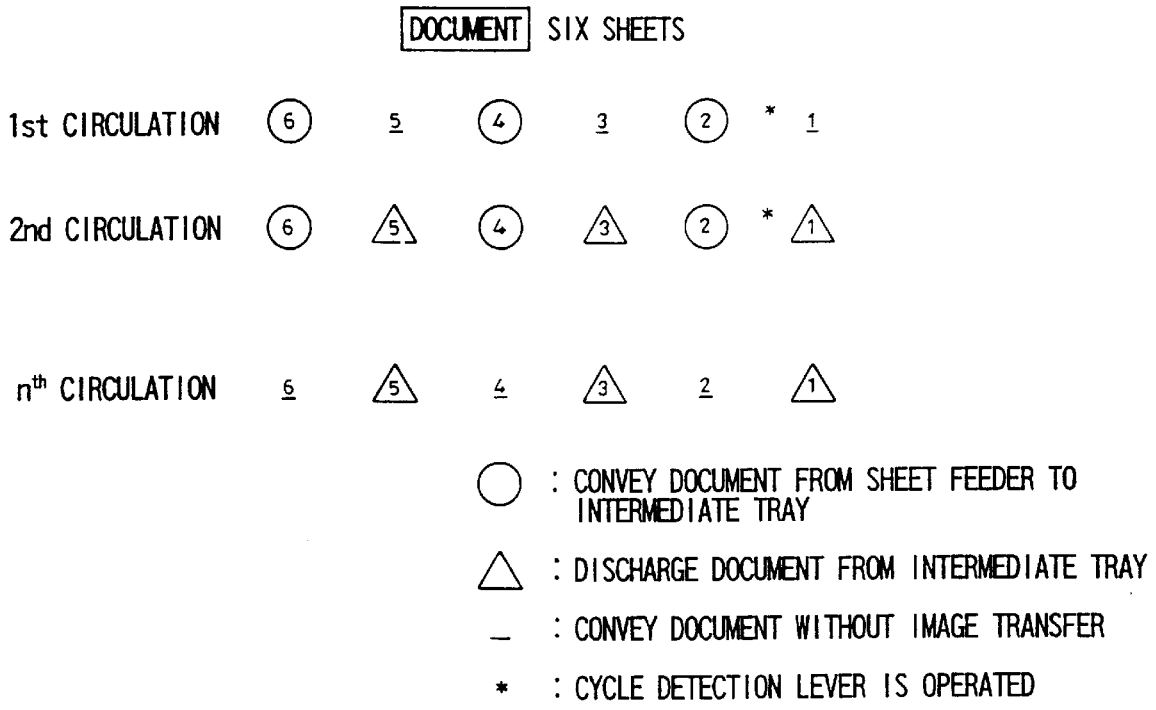
FIG. 20 is a view showing an operation pattern of the copying machine of the present invention in S→D mode.

The above is an explanation of a mode for obtaining double-sided copies from one-sided documents (referred to as a S D mode). According to this mode, it is noted that there are two sets of copies existing in the intermediate tray after the second or later circulation. In FIG. 20, a reference symbol (⊗) shows timing for the cycle detecting lever to move with respect to recording sheet. The cycle detecting lever moves when the final one-sided copy 2 enters into the intermediate tray. With the movement of the lever, it is possible to separate the copy sets P1 and P2 as shown in FIG. 9.

Figures 22, 23:
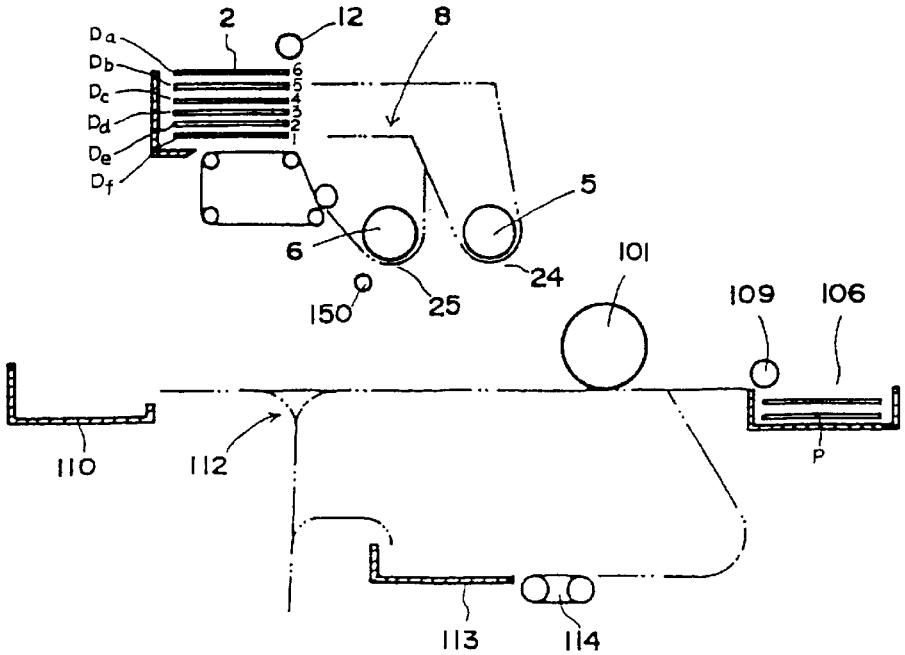
FIG. 22 is a view showing an operation pattern of the copying machine of the present invention in S→D mode.
FIG. 23 is a view showing a first operation state of the copying machine of the present invention in S→D mode.
Figure 24:
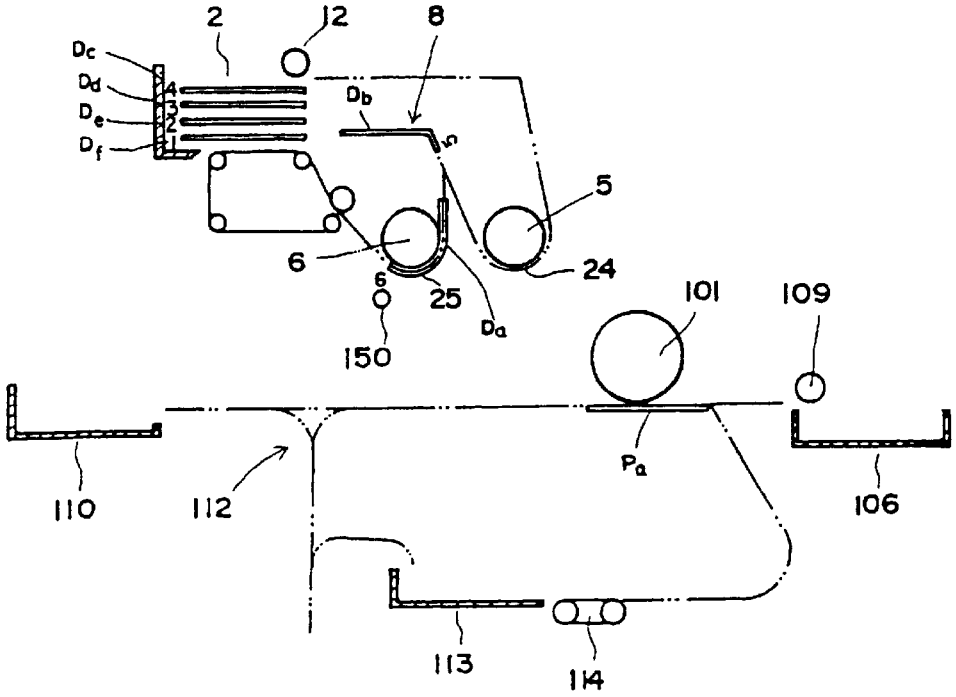
FIG. 24 is a view showing a second operation state of the copying machine of the present invention in S→D mode.

However, in the case where the polarity of the sensor S19 does not change, when the solenoid SOL1 moves and the power turned on, it is impossible to separate two sets of copies. Thus, when a copying operation starts in the S D mode, the first circulation and $N^{th}$ circulation in FIG. 20 are alternately repeated (a skip mode: FIG. 22), and thereby only one set of copies exists in the intermediate tray and double-sided copies can be obtained from one-sided documents regardless of the operation of the solenoid SOL1 or the change in the polarity of the sensor S19.

Figure 21:
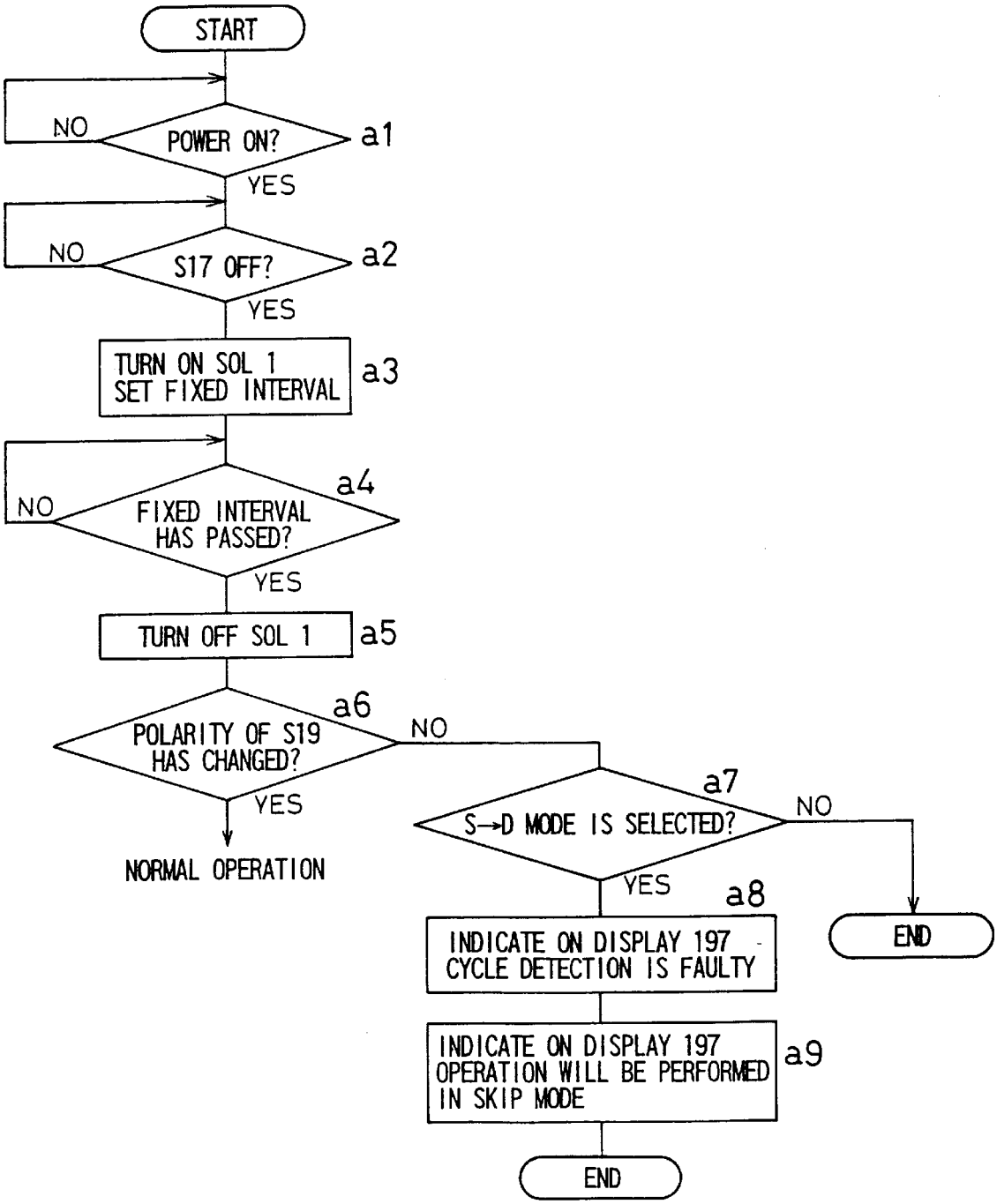
FIG. 21 is a flow chart of a second embodiment of the copying machine of the invention.

The second embodiment will be explained according to the steps set forth in the flow chart in FIG. 21. When the intermediate tray has no sheets in it with the power turned on at step a1, an in-intermediate-tray sheet's presence/absence sensor S17 (FIG. 1) is off and the sensor S19 is being on at step a2. In this state, when the solenoid SOL1 is turned on at step a3 and turned off again at step a5 after a fixed interval at step a4, the sensor S19 is turned off at step a6 as shown in FIG. 7 and turned on again. However, when the polarity of the sensor S19 does not change even in the state shown in FIG. 7, it is judged that a cycle detecting failure has occurred.

As described above, when the cycle detecting is judged to be faulty and the S D mode is selected at step a7, the display 197 indicates that the detecting is faulty at step a8 and that an operation in the skip mode will be performed at step a9. Timing for indicating the detecting failure may be arbitrarily set, for example, as the time of judgment of the detecting to be faulty.

The in-intermediate-tray sheet's presence/absence sensor S17 shown in FIG. 1 is a reflective sensor whose polarity becomes on when detecting a sheet of paper in the intermediate tray, and becomes off when no sheet is in the tray.

In the third embodiment, when the power is turned on, the polarity of the in-intermediate-tray sheet's presence/absence is off indicating there is no sheet in the intermediate tray. In this state, the cycle detecting lever LV1 is positioned as shown in FIG. 5 and the cycle detecting sensor S19 is in the on state. However, when a copying operation starts in the S D mode while the sensor S19 remains off, due to some failure, it is not judged that the sensor S19 has not been turned on until sheets Pc in the intermediate tray shown in FIG. 25 of the first embodiment are delivered. Also, when the power is on, the polarity of the detecting sensor S19 is on both before and after the movement of the cycle detecting lever LV1, so that it is necessary to detect the change in the polarity of the sensor S19 within a minimal period of time when the detecting lever LV1 is moving, and thereby control is made complicated.

With the power turned on, when the detecting sensor S19 is in the off state and no sheet in the intermediate tray (The in-intermediate-tray sheet's presence/absence sensor S17 is off.), the judgment of the cycle detecting failure may be performed by the time of starting a copying operation, so that an easy control system can be formed.

FIGS. 10 to 19 are diagrams for explaining a double-side copying operation of a double-sided document, showing an operation in which two documents Da, Db are copied on their double sides. Hereinafter, for the description of the front surface of a document D, a subscript "a" represents the first document, and a subscript "b" represents the second document. Also the subscripts of numerals 1 to 4 represent page numbers of the stacked documents D; for example, the first page of the first document is designated Da1. Similarly, also for the description of the front surface of the recording sheet P, subscripts "a", "b" and subscripts 1 to 4 are used. Those having the same subscript in the reference numerals of the document D and the recording sheet P have a relationship between a front surface of the document D to be read and a front surface of the recording sheet P onto which the front surface of the document D to be read has been copied.

For convenience's sake, in the drawings, a numeral representing a page number is given to the surface of each document D, and in particular, a whitened triangular symbol is given to the surface of an odd numbered document. Also, in each recording sheet P, a numeral representing the surface of the read document is given to the surface that is over the copying, and in particular, a blackened triangular symbol is given to the surface of an odd numbered document. Further, for a generic description of the document D and the recording sheet P, the subscripts are omitted.

Figure 10:
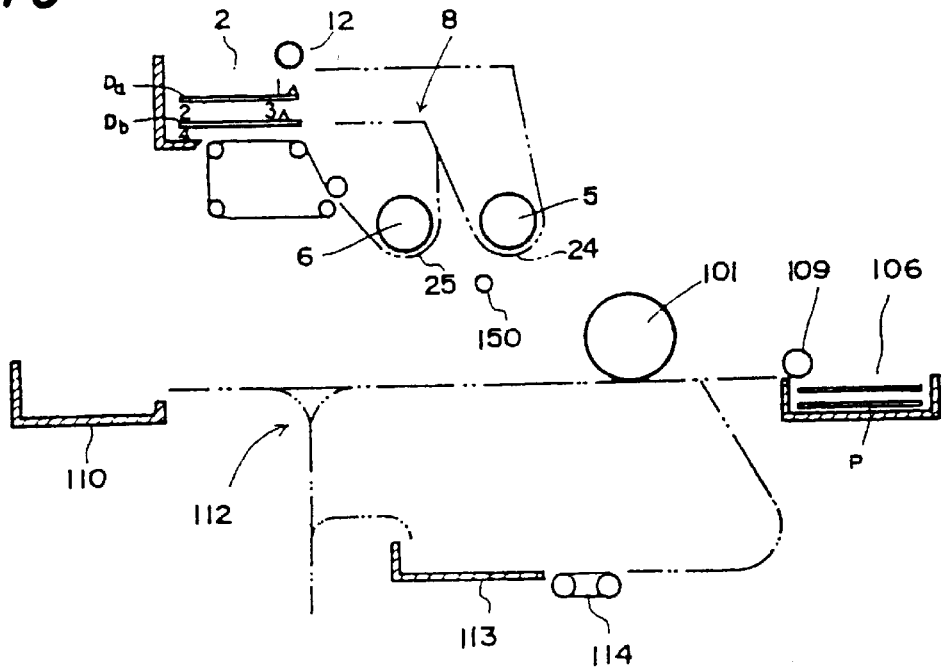
FIG. 10 is a view showing a first operation state of the copying machine of the present invention in D→D mode.

Document sheets D are stacked in the document storage 5 for double-side copying, in such an order that the page number increases sequentially from top to bottom, as shown in FIG. 10. Also, recording sheets P are stacked and stored in the cassette 106.

Figure 11:
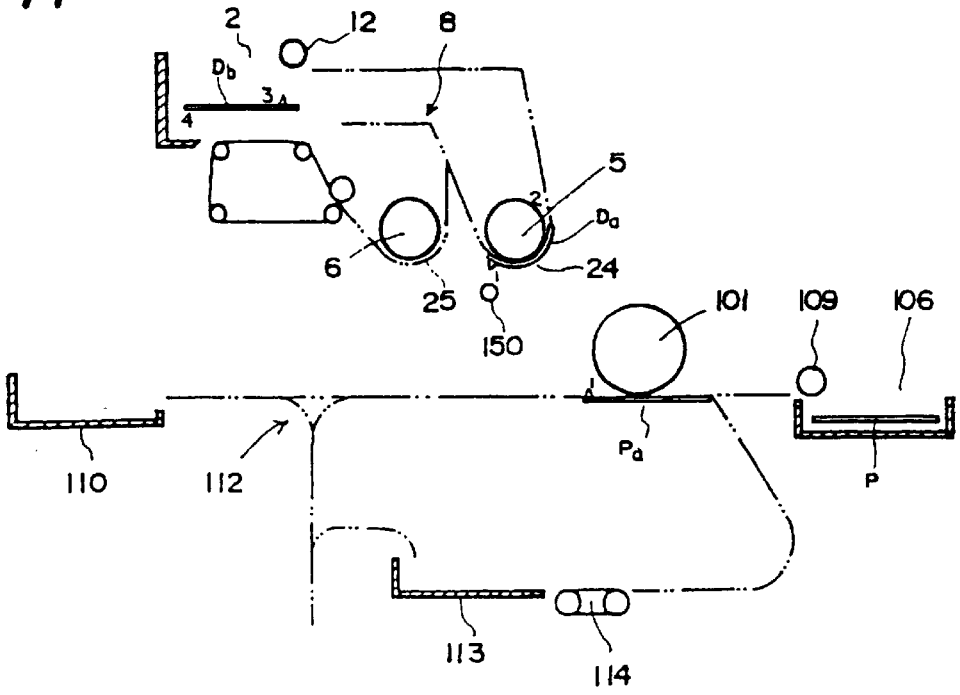
FIG. 11 is a view showing a second operation state of the copying machine of the present invention in D→D mode.

When the double-sided copying process is started, the document Da located uppermost of the documents D stacked in the document storage 2 is conveyed to a first reading region 24, as shown in FIG. 11, where the first page Da1 is read and copied to one surface Pa1 of the first recording sheet Pa.

Figure 12:
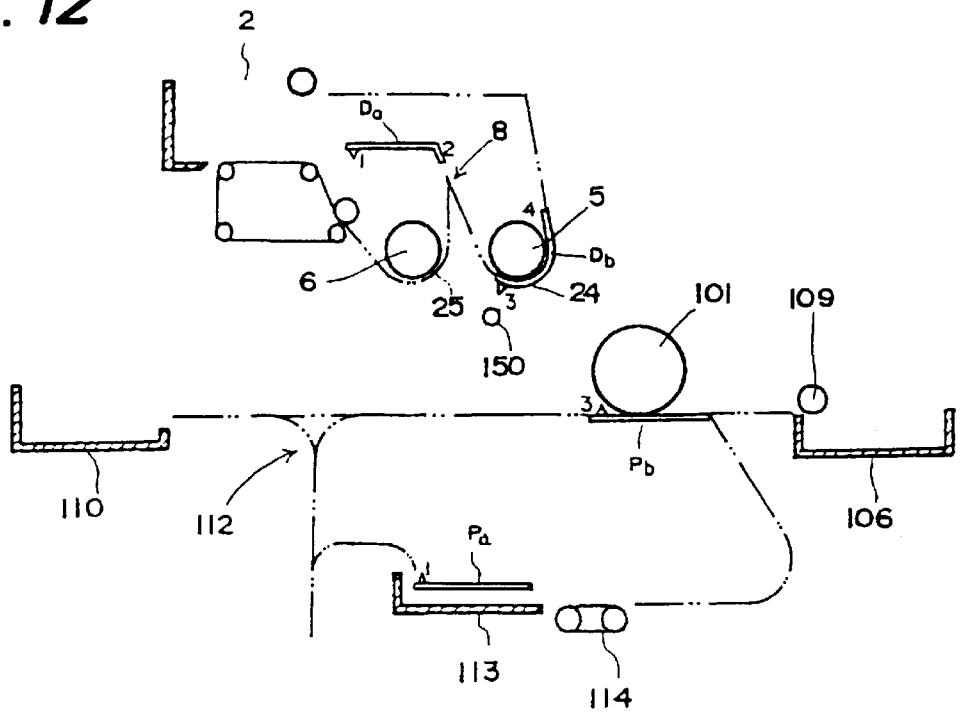
FIG. 12 is a view showing a third operation state of the copying machine of the present invention in D→D mode.

The first document Da, whose first page Da1 has been read in the first reading region 24, is conveyed to the document reversal means 8, and a copying operation to one surface Pb3 of the second recording sheet Pb is executed as shown in FIG. 12.

Figure 13:
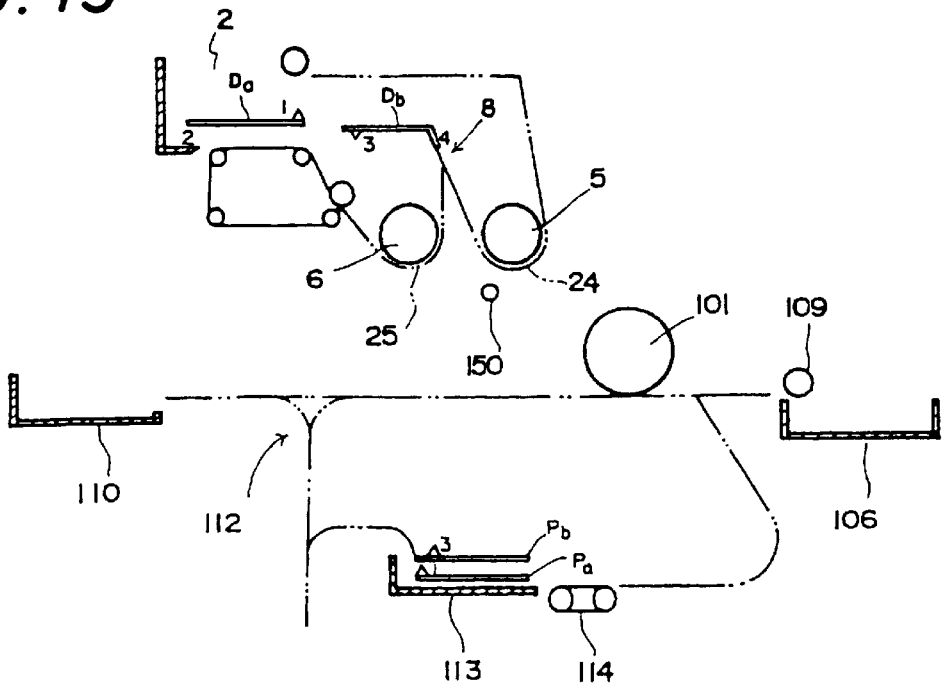
FIG. 13 is a view showing a fourth operation state of the copying machine of the present invention in D→D mode.

The documents Da, Db, one-side surfaces of which have been read in the first reading region 24, pass through a second reading region 25 via the document reversal means S without being read, as shown in FIG. 13, thus being temporarily returned to the document storage 2. The recording sheets Pa, Pb, which are over the copying onto their one-side surfaces, are conveyed to and stacked on the intermediate tray 113 via the recording-sheet reversal means 112.

Figure 14:
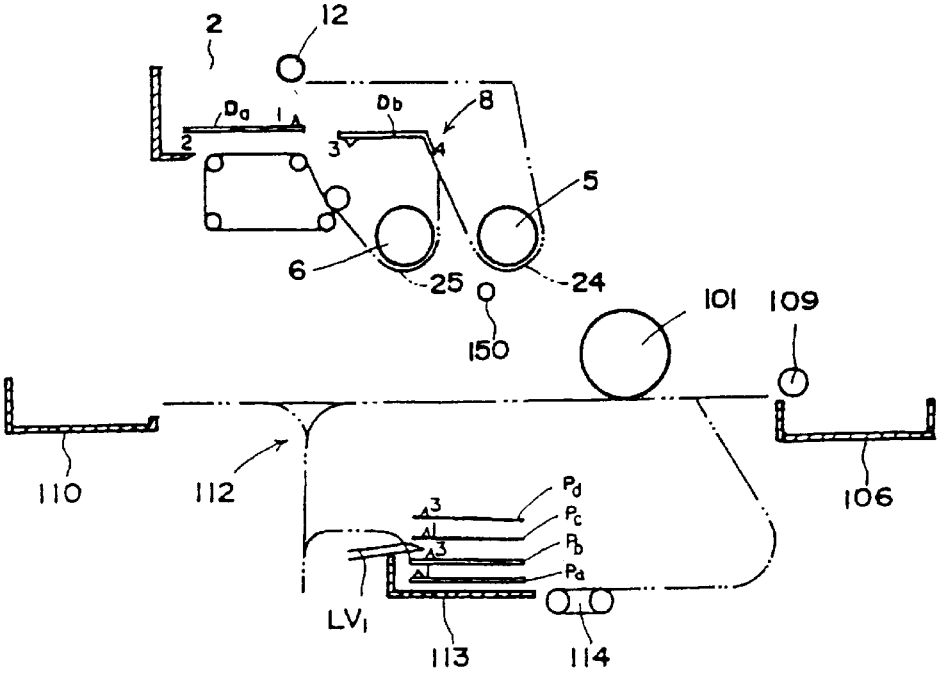
FIG. 14 is a view showing a fifth operation state of the copying machine of the present invention in D→D mode.

By repeating the above, as shown in FIG. 14, two sets of one-sided copies from the documents Da and Db exist in the intermediate tray. In this state, when a final copy Pb3 of the first set enters into the intermediate tray, the two sets of copies can be separated by moving the cycle detecting lever.

Figure 15:
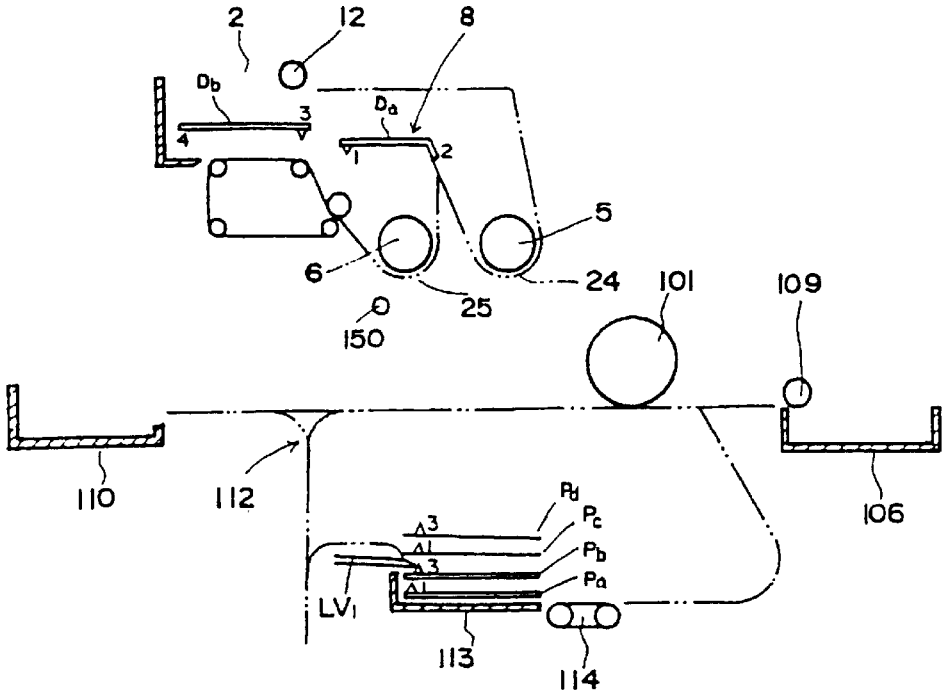
FIG. 15 is a view showing a sixth operation state of the copying machine of the present invention in D→D mode.
Figure 16:
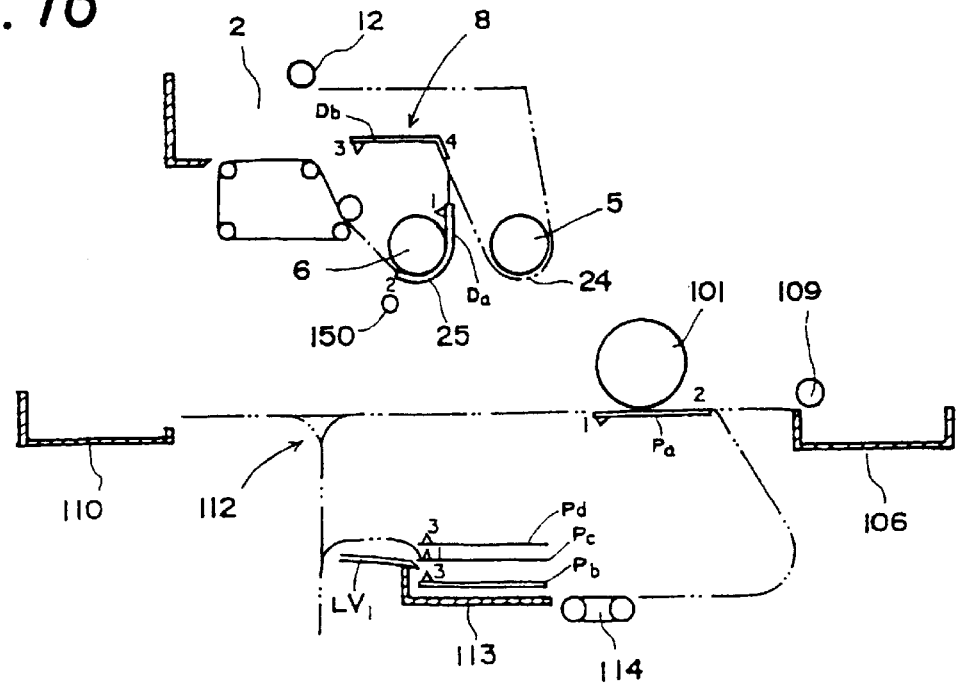
FIG. 16 is a view showing a seventh operation state of the copying machine of the present invention in D→D mode.

Subsequently, for the copying of the other surface that has not been copied yet, the documents Da, Db are conveyed to the reading regions. The first document Da re-fed from the document storage 2 passes through the first reading region 24 without being read, as shown in FIG. 15, and is conveyed to the document reversal means 8. Thereafter, as shown in FIG. 16, the second page Da2 of the first document Da that has not been read yet is read at the second reading region 25, and copied to the uncopied other surface Pa2 of the first recording sheet Pa, which has been fed from the lowermost position out of the recording sheets P stacked on the intermediate tray 113.

Figure 17:
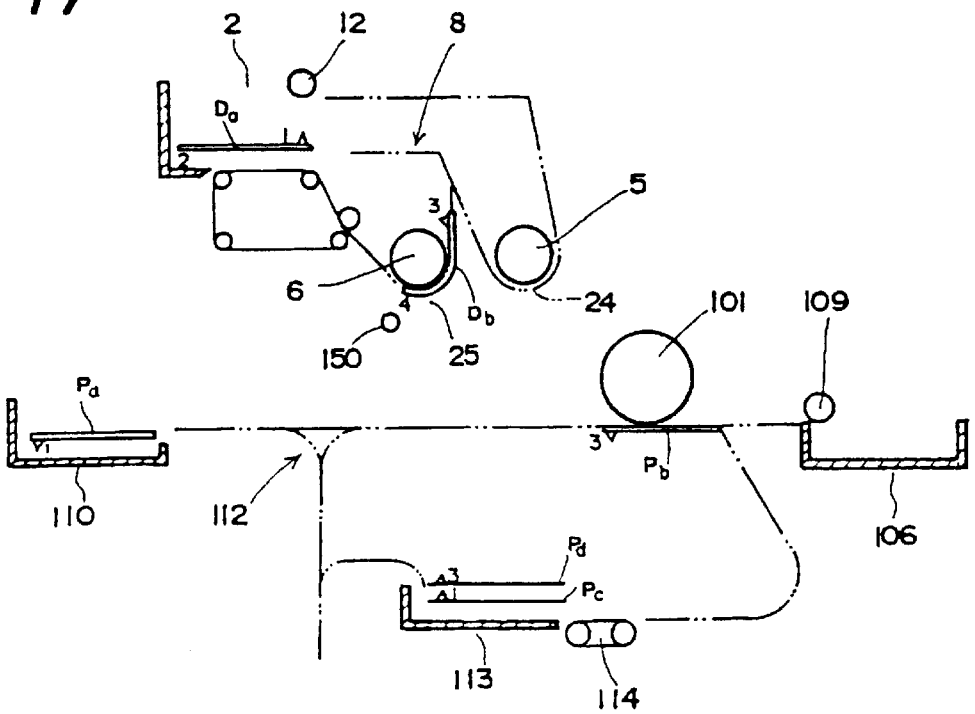
FIG. 17 is a view showing an eighth operation state of the copying machine of the present invention in D→D mode.
Figure 18:
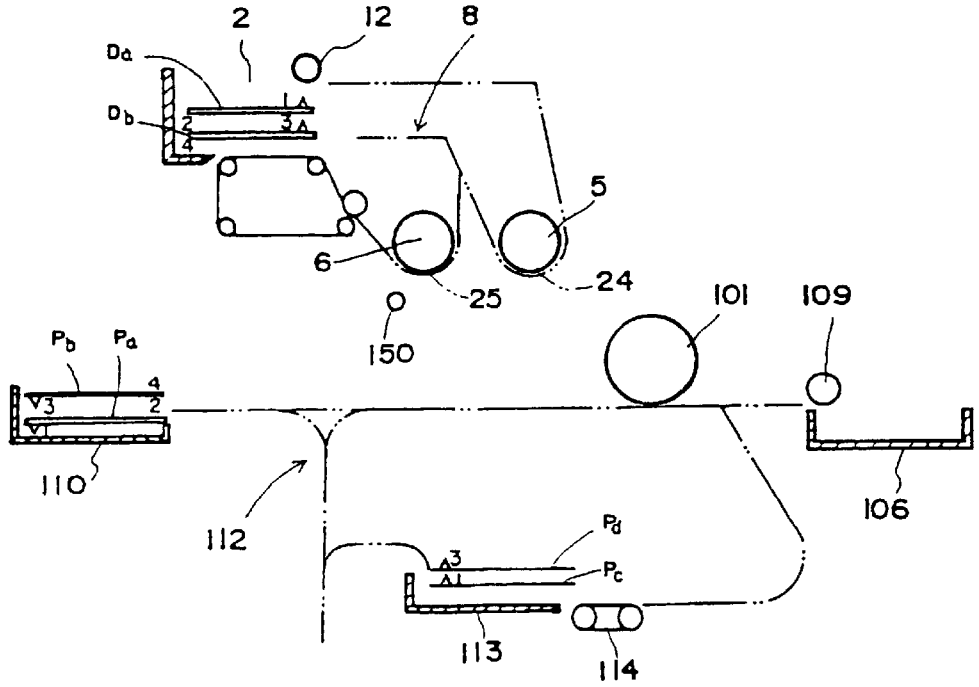
FIG. 18 is a view showing a ninth operation state of the copying machine of the present invention in D→D mode.
Figure 19:
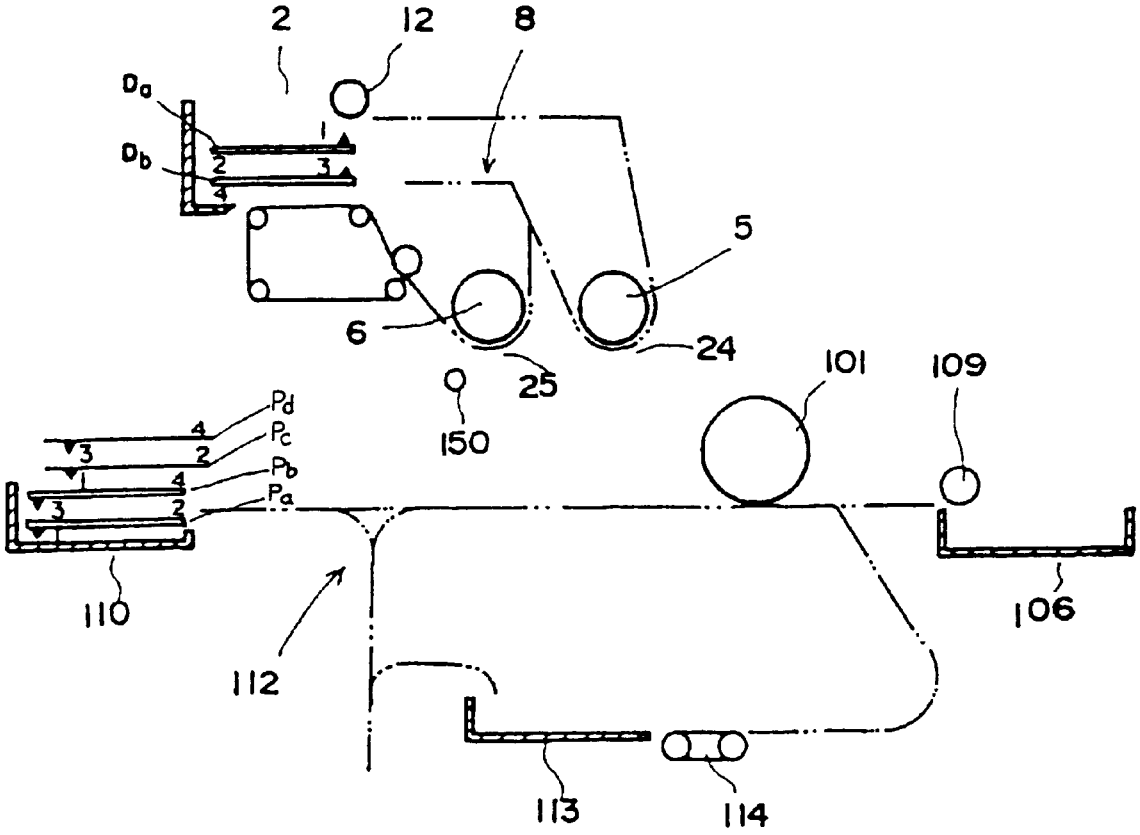
FIG. 19 is a view showing a tenth operation state of the copying machine of the present invention in D→D mode.

Also, as to the second document Db, as shown in FIGS. 17 and 18, its fourth page Db4 that has not been read yet is read at the second reading region 25, and copied to the uncopied other surface Pb4 of the second recording sheet Pb fed from the intermediate tray 113. Thereafter, the documents Da, Db are returned to and stored in the document storage 2, while the recording sheets Pa, Pb are ejected to the ejection tray 110.

Furthermore, by repeating the above operation, two sets of the double-sided copied recording sheets can be discharged into the ejection tray (FIG. 31).

However, with the power turned on, and when the polarity of the sensor S19 does not change even though the cycle detecting solenoid SOL1 is operated, it is impossible to separate two sets of copies. Thus, when a copying process starts in the D D mode, a copying operation at the first reading region 24 and a copying operation at the second reading region are alternately repeated for each cycle, so that only one set of copies exists in the intermediate tray, and thereby double-sided copies can be obtained from double-sided documents regardless of the movement of the detecting solenoid SOL1 and the change in the polarity of the sensor S19 (FIG. 32).

What is claimed is:

1. A method of copying for forming N sets of double-sided copies by circulating one-sided documents, the method comprising:

a first document circulating step of copying images of even ordinal numbered ones of the one-sided documents on front faces of unused sheets and then storing the one-side copied sheets into an intermediate tray;

a second document circulating step of copying images of odd ordinal numbered ones of the one-sided documents on rear faces of the one-side copied sheets sent from the intermediate tray, discharging the double-sided copies, copying the images of the even ordinal numbered ones of the one-sided documents on front faces of unused sheets and then storing the one-side copied sheets into the intermediate tray;

a third document circulating step of copying images of odd ordinal numbered ones of the one-sided documents on rear faces of the one-side copied sheets sent from the intermediate tray and then discharging the double-side copied sheets;

a cycle judging step of judging by a cycle detecting sensor whether a set of one-side copied sheets has been stored into the intermediate tray since a cycle detecting solenoid for separating sets of one-side copied sheets was last operated, in which case the cycle detecting solenoid is operated; and breakdown judging step of judging by controlling means that the cycle detecting sensor is out of order in the case where the cycle detecting solenoid is operated and a polarity of the cycle detecting sensor is not changed, the method of copying in which N sets of double-sided copies are formed by sequentially executing the first document circulating step once, the second document circulating step (N−1) times, and the third document circulating step once, wherein when it is judged in the breakdown judging step that the cycle detecting sensor is out of order, an operation of executing the first document circulating step once and the third document circulating step once in turn is repeated to form N sets of double-sided copies.

2. The method of copying of claim 1, further comprising a displaying step of displaying on a display unit that copying is performed in skip mode in the case where in the breakdown judging step it is determined that the cycle detecting sensor is out of order.

3. A method of copying for forming N sets of double-sided copies by circulating double-sided documents, the method comprising:

a first document circulating step of copying images of rear faces of the double-sided documents on front faces of unused sheets and then storing the one-side copied sheets into an intermediate tray;

a second document circulating step of copying images of front faces of the double-sided documents on rear faces of the one-side copied sheets sent from the intermediate tray and then discharging the double-sided copies;

a cycle judging step of judging by a cycle detecting sensor the cycle detecting solenoid is operated; and a cycle judging step of judging by a cycle detecting sensor whether a set of one-side copied sheets has been stored into the intermediate tray since a cycle detecting solenoid for separating sets of one-side copied sheets was last operated, in which case the cycle detecting solenoid is operated; and breakdown judging step of judging by controlling means that the cycle detecting sensor is out of order in the case where the cycle detecting solenoid is operated and a polarity of the cycle detecting sensor is not changed, the method of copying in which N sets of double-sided copies are formed by repeating an operation of executing the first document circulating step two times and the second document circulating step two times in turn is repeated until the first document circulating step is executed N times and the second document circulating step is executed N times, wherein when it is judged in the breakdown judging step that the cycle detecting sensor is out of order, an operation of executing the first document circulating step once and the second document circulating step once in turn is repeated N times to form N sets of double-sided copies.

4. The method of copying of claim 3, wherein a sensor capable of detecting the presence or absence of sheets is provided in the intermediate tray, the method further comprising another breakdown judging step of determining that the cycle detecting sensor of the intermediate tray is out of order, when the sensor does not detect the presence of sheet and the cycle detecting sensor of the intermediate tray is off.

* * * * *